US011015854B2

(12) United States Patent
Jacobi

(10) Patent No.: US 11,015,854 B2
(45) Date of Patent: May 25, 2021

(54) MODULAR SYSTEM FOR HEATING AND/OR COOLING REQUIREMENTS

(71) Applicant: Robert W. Jacobi, Indianapolis, IN (US)

(72) Inventor: Robert W. Jacobi, Indianapolis, IN (US)

( * ) Notice: Subject to any disclaimer, the term of this patent is extended or adjusted under 35 U.S.C. 154(b) by 0 days.

(21) Appl. No.: 16/103,076

(22) Filed: Aug. 14, 2018

(65) Prior Publication Data

US 2018/0363969 A1 Dec. 20, 2018

Related U.S. Application Data

(60) Division of application No. 15/876,377, filed on Jan. 22, 2018, which is a continuation of application No. PCT/US2017/043510, filed on Jul. 24, 2017.

(Continued)

(51) Int. Cl.
*F25B 25/00* (2006.01)
*F25B 29/00* (2006.01)

(Continued)

(52) U.S. Cl.
CPC ..... *F25D 13/02* (2013.01); *A47B 81/00* (2013.01); *F25B 13/00* (2013.01); *F25B 25/005* (2013.01);

(Continued)

(58) Field of Classification Search
CPC ..... F25D 13/00; F25D 13/02; F25D 19/02; F25D 19/04; A47B 81/00; F24F 2221/36;

(Continued)

(56) References Cited

U.S. PATENT DOCUMENTS 1,825,694 A * 10/1931 Hobart ..... F25D 19/02 62/450
2,445,988 A 7/1948 Ayers (Continued)

FOREIGN PATENT DOCUMENTS

CN 101915487 A * 12/2010
EP 0936421 A2 * 8/1999 ..... F25B 1/00

(Continued)

OTHER PUBLICATIONS

English Abstract of FR 3034849 A1 obtained from Lexis-Nexis Total Patent on Jan. 31, 2020.

*Primary Examiner* — Jianying C Atkisson
*Assistant Examiner* — Miguel A Diaz
(74) *Attorney, Agent, or Firm* — Woodard, Emhardt, Henry, Reeves & Wagner, LLP

(57) ABSTRACT

A racked modular system for heating and/or cooling requirements includes a first plurality of equipment modules, a second plurality of equipment modules, a first storage rack and a second storage rack. The first storage rack is constructed and arranged to receive the first plurality of equipment modules. The second storage rack is constructed and arranged to receive the second plurality of equipment modules. The disclosed system also includes a plurality of water manifolds which are constructed and arranged for interconnecting the first plurality of equipment modules with the second plurality of equipment modules. In one exemplary embodiment the equipment modules are chillers.

20 Claims, 35 Drawing Sheets

Related U.S. Application Data

(60) Provisional application No. 62/366,359, filed on Jul. 25, 2016.

(51) Int. Cl.

| | |
|---|---|
| ***A47B 81/00*** | (2006.01) |
| ***F25D 23/10*** | (2006.01) |
| ***F24F 5/00*** | (2006.01) |
| ***F25D 13/02*** | (2006.01) |
| ***F25B 13/00*** | (2006.01) |

(52) U.S. Cl.
CPC ..... *F25B 29/00* (2013.01); *F25D 23/10* (2013.01); *F24F 5/0046* (2013.01); *F24F 2221/36* (2013.01); *F25B 2339/047* (2013.01); *F25B 2400/06* (2013.01)

(58) Field of Classification Search
CPC .... F24F 13/32; F24F 3/044; F24F 3/02; F24F 3/04; F24F 3/10; F24F 3/12; F24F 11/83; F24F 11/84; F24F 11/85; F25B 25/005; F25B 19/04
See application file for complete search history.

(56) References Cited

U.S. PATENT DOCUMENTS 4,852,362 A * 8/1989 Conry ..... F25B 49/02 62/175
5,335,508 A 8/1994 Tippmann
5,440,894 A * 8/1995 Schaeffer ..... F25B 1/00 62/203
5,485,878 A 1/1996 Derks
5,999,403 A 12/1999 Neustadt
6,094,934 A * 8/2000 Rand ..... A47F 3/0408 312/116
6,651,454 B1 * 11/2003 Spiegel ..... F24F 13/32 62/259.1
6,749,070 B2 6/2004 Corbett, Jr.
6,819,563 B1 11/2004 Chu et al.
7,254,952 B2 8/2007 Lilke
7,365,973 B2 4/2008 Rasmussen
7,484,552 B2 2/2009 Pfahnl
7,775,058 B2 * 8/2010 Kaga ..... F25D 21/04 62/157
7,810,341 B2 10/2010 Belady
8,113,010 B2 2/2012 Carlson
8,522,565 B1 9/2013 Hauck et al.
8,857,202 B1 10/2014 Meissner
8,910,491 B2 12/2014 Iovanel
9,091,451 B2 * 7/2015 Hansen ..... B64F 1/364
9,101,080 B2 8/2015 Czamara
9,114,881 B2 * 8/2015 Mar ..... B64D 13/08
9,173,307 B2 10/2015 Lee
9,352,836 B2 5/2016 Lamey
9,839,163 B2 * 12/2017 Keisling ..... H05K 7/20745
9,901,190 B2 * 2/2018 Resch ..... A47F 3/0443
9,930,974 B2 4/2018 Resch
2004/0072534 A1 * 4/2004 Wiley ..... G06F 1/183 454/184
2007/0002536 A1 * 1/2007 Hall ..... G06F 1/20 361/695
2007/0167125 A1 7/2007 Rasmussen et al.
2008/0018212 A1 1/2008 Spearing et al.
2008/0041077 A1 2/2008 Tutunoglu
2008/0116289 A1 5/2008 Lochtefeld
2008/0163632 A1 * 7/2008 Kaga ..... F25D 21/04 62/190
2008/0164006 A1 * 7/2008 Karamanos ..... F24F 1/0059 165/67
2008/0198549 A1 * 8/2008 Rasmussen ..... H05K 7/2079 361/696
2009/0019874 A1 * 1/2009 Park ..... F24F 1/00 62/259.1
2009/0107163 A1 4/2009 Lu et al.
2009/0112368 A1 4/2009 Mann, III et al.
2009/0151388 A1 * 6/2009 Platt ..... F25B 29/003 62/498
2010/0132390 A1 * 6/2010 Platt ..... F25B 29/003 62/238.7
2010/0188816 A1 7/2010 Bean, Jr. et al.
2010/0236772 A1 * 9/2010 Novotny ..... H05K 7/2079 165/287
2010/0300129 A1 * 12/2010 Bean, Jr. ..... F25B 49/005 62/129
2010/0307178 A1 * 12/2010 Hansen ..... B64F 1/364 62/132
2011/0063778 A1 * 3/2011 Brouillard ..... H05K 7/20645 361/678
2011/0168379 A1 * 7/2011 Morgan ..... H05K 7/20827 165/287
2011/0252821 A1 * 10/2011 Miglio ..... F25B 29/003 62/238.7
2011/0299242 A1 * 12/2011 Grantham ..... H05K 7/20745 361/688
2012/0012283 A1 1/2012 Bean, Jr. et al.
2012/0113592 A1 5/2012 Chen
2012/0125028 A1 * 5/2012 Keisling ..... H05K 7/20827 62/228.1
2012/0134108 A1 5/2012 Brouillard
2012/0273185 A1 11/2012 Arimilli
2012/0297811 A1 * 11/2012 Miglio ..... F25B 29/003 62/324.1
2013/0032310 A1 * 2/2013 Jaena ..... F28D 15/02 165/104.25
2013/0077238 A1 * 3/2013 Babish ..... H01L 23/473 361/689
2013/0105139 A1 * 5/2013 Campbell ..... H05K 7/20709 165/300
2013/0107447 A1 * 5/2013 Campbell ..... H05K 7/20709 361/679.47
2014/0060107 A1 3/2014 Chen et al.
2014/0206271 A1 7/2014 Ignacio
2014/0230472 A1 * 8/2014 Coradetti ..... F25D 29/008 62/125
2015/0040607 A1 2/2015 Miglio
2015/0193320 A1 7/2015 Yu
2015/0198353 A1 * 7/2015 Platt ..... F24F 13/32 62/298
2015/0272345 A1 10/2015 Bhatia et al.
2015/0351290 A1 12/2015 Shedd
2016/0021793 A1 1/2016 Chen
2016/0107561 A1 4/2016 Senaydin
2016/0305702 A1 * 10/2016 Nikaido ..... F25B 49/02
2017/0074560 A1 3/2017 Ring
2017/0086333 A1 * 3/2017 Roy ..... G06F 1/20
2017/0105313 A1 * 4/2017 Shedd ..... H05K 7/20272
2017/0215620 A1 8/2017 Dade et al.
2017/0268792 A1 * 9/2017 Costakis ..... F24F 11/83
2018/0027698 A1 1/2018 Cader et al.
2018/0231295 A1 * 8/2018 Akiyama ..... F25D 17/02
2018/0306492 A1 10/2018 Nanos et al.
2018/0372369 A1 12/2018 DeMonte et al.
2019/0032987 A1 1/2019 Tippmann et al.
2019/0195514 A1 * 6/2019 White ..... F24F 1/0007
2019/0226749 A1 * 7/2019 Lee ..... F25D 11/00

FOREIGN PATENT DOCUMENTS

EP 2594485 A1 * 5/2013 ..... B64D 13/08
FR 3034849 10/2016
JP 2012117778 A * 6/2012
WO WO-9105977 A1 * 5/1991 ..... F25B 1/00
WO WO-2008110800 A2 * 9/2008 ..... F25D 19/02
WO WO 2013/189013 12/2013

* cited by examiner

MODULAR SYSTEM FOR HEATING AND/OR COOLING REQUIREMENTS

CROSS-REFERENCE TO RELATED APPLICATIONS

This application is a divisional of U.S. application Ser. No. 15/876,377, filed Jan. 22, 2018 which is a continuation of PCT/US2017/043510 filed Jul. 24, 2017 which claims the benefit of U.S. Provisional Application No. 62/366,359 filed Jul. 25, 2016, which is hereby incorporated by reference.

BACKGROUND

Modular designs and modular construction are currently employed in a variety of settings and for a variety of applications. When one thinks of a "modular design", one description which is applicable to the present invention is a design approach which divides a larger system or network into smaller parts, i.e. modules, which can be independently created, typically or often standardized in construction and function, and used in combination for the larger system or network. A modular design is also described as functional partitioning into discrete scalable, reusable modules with the use of well-defined modular interfaces. Industry standards are often used for the interfaces or at least considered as a part of the interface design.

Modular designs and modular design concepts are found in the electronics industry, home construction, military systems, and the like. However, these "modules" are not usually of the same construction as multiples of a particular equipment or functional design in order to multiply capacity. Instead, many of these other applications involve a "modular" concept which is limited to independent packaging of a particular function which is to be networked with other modules of a different construction for the completion of a larger system or network. For example, a computer may have as its typical "modules" power supply units, processors, main boards, graphics cards, hard drives, optical drives, etc.

Modular design is an attempt to combine the advantages of standardization with those of customization. While some form or variation of modular design has found its way into a number of industries and applications, the concept has had limited success for HVAC, industrial process cooling, low-temperature heating and in refrigeration systems. The present invention is directed to enhanced modular design utilization in these areas and in related areas and applications.

SUMMARY

The present invention discloses novel and unobvious concepts, constructions, designs and functions relating to modular designs which are applicable for HVAC, industrial process cooling, low-temperature compressor generated hot water heating (with up to 140 degrees F. supply hot water when using R410A) and in refrigeration systems, and forms a complete modular central energy plant (CEP).

The present invention employs a novel and unobvious combination of two modular concepts allowing for improved flexibility while providing high thermal capacities with a small footprint. Individual modules have single circuit constructions, though dual circuits are contemplated and are within the scope of the present invention. These individual modules according to an exemplary embodiment of the present invention can be supplied, for example, as air or water cooled chillers, heater/chillers, refrigeration units, direct expansion (DX) or variable refrigerant volume/variable refrigerant flow (VRV/VRF).

The exemplary embodiment of the present invention includes a number of novel and unobvious design features, characteristics, capabilities, functions and uses. Some of these novel and unobvious design features, characteristics, capabilities, functions and uses are listed below as a convenient way to provide a summary or overview of what is disclosed and illustrated more fully herein. A careful study of the drawings will enable a person of ordinary skill in this field of art to be able to make and use the claimed invention.

1. The present invention is a design standard that uses a multi-module racking concept for construction of a complete HVAC or process heating and/or cooling system allowing for a plethora of heating and cooling technologies in the smallest footprint possible with extremely high Btu/sq. ft. capacity within the allowable space volume.
2. The present invention employs a multi-module concept to build the racked structure from field assembled components similar to warehouse racking superstructure systems combining individual vertical and horizontal components with multiple trays (similar to pallets) to hold removable component assemblies.
3. The present invention is applicable to large or small residential, commercial, institutional, industrial HVAC and process cooling and heating plus refrigeration and domestic hot water applications.
4. The present invention systems can include complimentary multi-module vertically or horizontally mounted heating, pumping, heat exchange, hydronic specialties and water quality components assembled for a complete system, and form a complete modular CEP.
5. The present invention includes a system of innovative indoor or outdoor mounted air and/or adiabatic coolers and condensers for heat rejection (or heat pump heating).
6. A key feature of the present invention is the ability to remove individual modules and easily reinstall a "spare" backup module thus providing a minimum downtime system, all while all other modules remain operational.
7. The present invention modules that need repair can be transported to an in-house repair facility or sent to an out of house repair facility.
8. The present invention is a system that can be adapted to ultra low pressure drop piping designs.
9. The present invention is preconfigured for N+1 and N+2 critical use duty using racked modules and multiple arrays.
10. The present invention is adaptable to energy and/or thermal storage systems.
11. The present invention is a flexible system for design from small projects using single racks including cooling, heating and pumping on one racked module to large systems with multiple types of racked modules and component systems.
12. The present invention includes analytics for operational, maintenance and service communication with supervisory and service personnel using wired and wireless local networks, the internet, cellular including apps for handheld mobile devices and will be adaptable to future communication technologies.
13. The present invention uses programmable software or machine language to interpret the operational factors that will control individual components for both the space or process heating and cooling loads and the equipment system to provide the central and remote heating and cooling equipment functionality to meet operational requirements using the least amount of energy or natural resources (i.e. water, carbon, solar, etc.) and lowest utility billing structure.

14. The present invention uses sensors to collect and analyze individual component and system data including temperature, pressure, humidity, electrical, energy use, valve position and all relevant operational information to monitor and determine if system is in proper operation or needs service. If service is required, the present invention will notify both facility and service personnel and monitoring systems.
15. The present invention uses machine language and multi-dimension/multi-layered maps of all key system equipment (generation of hot and cold) and space or process load (point of use of heating and cooling) operation.
16. When the present invention is sold as a complete system a Systems Integrator will be responsible for proper design, installation, operation, service and integration with other building operation and automation systems.
17. The present invention will use either programmable software or machine language and use past operational data including seasonal, time of day, occupancy and climatic history combined with current operational, climate and energy use data to meet current operational requirements.
18. Full projects according to the present invention include a Systems Integrator that will be involved in all aspects of the design, installation and operation of the present invention starting with initial design and application engineering including selecting suitable components following guidelines for system design and application. The project system Design Engineer is responsible for the load calculations to determine the space or process heating and cooling requirements. In addition, the Design Engineer must determine the operational duty and time of use requirements to calculate if system diversity is a factor and if the system will operate as a zone load or a block load system. The Design Engineer will be responsible for designing interconnecting piping and selecting the in-space units that will use hot and cold water to produce hot or cold air to satisfy the actual heating and cooling load. The in space units could include: hydronic heating/cooling units for each unit/space/room or DX units with ductwork or VRF/VRV or in-floor heating (optional sensible only cooling), ventilation system equipment, selection of type of cooling equipment: sensible only or sensible and latent cooling and dehumidification and heating equipment and pumping or DX components. The System Integration guidelines will offer multiple options for footprint of the HVAC equipment. The Systems Integrator will assist with the selection of the CEP equipment including all types of heating, cooling, domestic hot water production, wastewater collection and transfer and electrical power systems with the assistance of design software to produce a preliminary CEP design Process and Instrumentation Drawing (P&ID). The Systems Integrator and Design Engineer will use the P&ID to lay out all interconnecting external piping, ductwork, electrical and control components and wiring required. Although there are numerous components, this will be a "packaged system" from the standpoint of components included for a fully operational CEP system and the Systems Integrator will be responsible for proper operation of the system.
19. Controls include the logic for heat rejection or heat recovery and to operate as either cooling only or simultaneous heating plus cooling modules. This includes the control system to ensure that proper pumping to heat rejection or to heat recovery and to keep each system in proper flow balance for the system demands.
20. The control system according to the present invention has the logic to pump the system using variable/primary with all necessary components and their proper operational control logic or the system can use primary/secondary system pumping with all required components and control logic.
21. The supervisory control system for the CEP equipment provides logic for all systems and interface with local control of compression, boilers/heat absorption, heat rejection, pumping, water use and quality, wastewater, electrical power and control.
22. The present invention establishes the Systems Integrator as the supervisor of all control operations and responsible for all control and system component operation. There is only one responsible party—the System Integrator. Under the System Integrator could be subcontractors and specified equipment suppliers, vendors, contractors, application and consulting engineers.

Note: The present invention uses a similar model for system design and operation as the original air conditioning systems designed by a selected manufacturer, such as Willis Carrier, with the manufacturer responsible for the design, installation and control of the air conditioning system. Unlike the original Willis Carrier systems, a consulting engineer or design/build team is responsible for the load calculation and individual piping run outs for the system. The job description for the System Integrator requires that they will work to ensure proper integration of equipment, system design and control.

23. The present invention is designed to have on site supervisory control for all the rack modules, arrays for heating, cooling, pumping or any of the other specialties that can be included. The Systems Integrator will work with programming for the site supervisory control that will be embedded with the system components and can provide all standard control requirements for the CEP. However, to assure peak efficiency, an optional internet based Prime Control System using sophisticated machine language, provides control for not only all the system, but interface with instrumentation to measure space conditions, operational history, current weather data, and utility interface for load shedding and/or demand management as required or where beneficial to energy and cost savings to provide the most efficient operation for the system.
24. The internet based Prime Control System provides sophisticated control of most building automation functions including lighting, occupancy, operable shades or screening, temperature/humidity management, security, fire suppression and any other building requirement that can benefit from a central control management system.
25. One objective of the internet based Prime Control System supervisory control is to maximize the most efficient use of onsite utilities including potable water, rainwater capture and reuse, gray water, reuse water (purple pipe), district/campus heating/cooling when available, grid based electrical power, site generated electrical power, carbon use thermal equipment, solar thermal heating, electrical and thermal energy storage.
26. In addition to new systems using the present invention, the internet based Prime Control System is available as an upgrade for the control of existing HVAC and upgraded control and building automation services.
27. The present invention can include either packaged or split system, air cooled, wet/dry or evaporative fluid coolers and combined with the racked chiller or heater/ chiller system would provide first stage cooling. The present invention may provide all piping, control components and logic for "free cooling" which could include as second stage an integration of free cooling plus use of compression air conditioning as a "trim cooler." The trim cooler is second stage and is useful as the system control switches in and out of free cooling. Free cooling would be third stage, but primary air conditioning mode when outdoor conditions permit. The "free cooling" option includes the piping, components and control logic for proper free cooling operation when outdoor temperatures allow this energy saving mode of operation.

28. The present invention includes control logic and maintenance logic for the water management for all adiabatic cooling functions and would primarily collect and use non-potable water whenever possible with potable water only as a backup, emergency operation.
29. The present invention includes piping, control components and control logic to recover waste heat whenever available and there is a simultaneous requirement for domestic hot water, HVAC water for reheat and dehumidification, or hot water for HVAC and system heating and cooling. Note that the integration of heating with simultaneous cooling will also integrate with the high efficiency condensing boilers that normally operate at a maximum 140 degrees F. The internet based Prime Control System is configured to use previous building operational history and outdoor weather data to predict most efficient use of simultaneous heating and cooling operation.
30. The internet based Prime Controller System functions as both the master supervisory control for all onsite HVAC and process controllers and also includes the analytics to interface with municipal and onsite utilities to integrate the control of HVAC, process heating/cooling, potable and non-potable water use, recover of building thermal heat and thermal heat from wastewater collection discharge, grid electrical power and onsite power generation including demand limiting programs and smart meter interface and to minimize the onsite carbon use.
31. The Prime Controller System may use software or machine language to analyze current and historical site operational data, current and future weather data, and interface with utilities to provide the most efficient, cost effective operation of the mechanical systems, buildings and grounds.

DESCRIPTION OF THE SELECTED EMBODIMENTS

Figure 1:
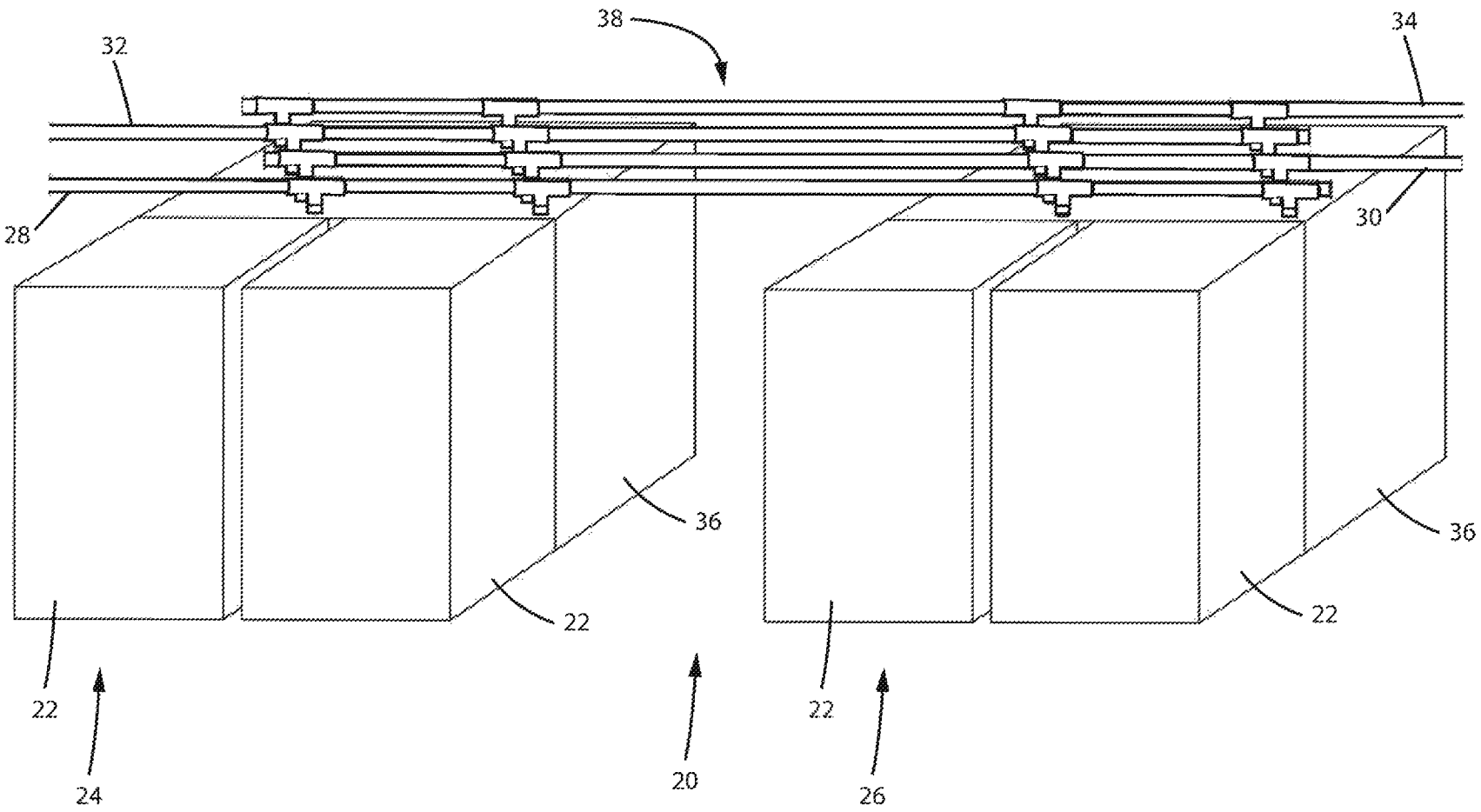
FIG. 1 is a perspective, diagrammatic illustration of a modular system for heating and/or cooling requirements including racked modular chillers according to an exemplary embodiment of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

As used herein, either in the specification (including the claims) or in the drawings, the following terms shall have the assigned meaning/definition as set forth below:

Adiabatic—relating to or denoting a process or condition in which heat does not enter or leave the system; occurring without loss or gain of heat. For the purpose of this invention the process is described as wet/dry cooling.

CGX—a coined acronym for "coaxial geothermal exchanger"

Chiller—an equipment unit or machine that removes heat from a liquid via a vapor-compression or absorption refrigeration cycle.

Condenser—apparatus used to condense vapor; an apparatus for reducing gases to their liquid or solid form by the abstraction of heat.

Cooler—a container, vessel or apparatus for cooling, such as a heat exchanger.

DX—a direct expansion type of central air-conditioning plant or system.

HVAC—used to describe equipment or systems relating to heating, ventilation and/or air conditioning.

Hydronic—a system of heating or cooling that involves transfer of heat by circulating fluid (as water or water/antifreeze) in a closed system of pipes or conduits.

Modular—referring to a design approach that subdivides a system into smaller parts called modules or skids, that can be independently created and then used in different systems. A modular system can be characterized by functional partitioning into discrete scalable, reusable modules, often with well-defined modular interfaces, making use of industry standards for interfaces.

N+1—this term describes a system or network which includes a spare unit or the availability of a spare unit if the primary or base unit goes out of service.

N+2—similar to the N+1 definition except this involves a double or redundant number of spare units and would be applicable for the most critical applications or systems which might need a second spare if the first spare fails or is defective.

VRV/VRF—acronyms used to describe a system or network or other equipment involving a variable refrigerant volume/variable refrigerant flow.

Wet/Dry Cooling—applies to using a media installed at the inlet to precool an air cooled condenser or fluid cooler heat transfer coil. When water is applied to the surface area of the media and fans bring air through the media causing the water to evaporate which causes the air to decrease in temperature while increasing in humidity. The net effect is a 5 degrees F. or 10 degrees F. or more decrease in entering air dry bulb temperature air to the condenser/cooler coil, which improves system efficiency Referring to FIG. 1 there is illustrated a racked modular system 20 which includes a plurality of racked modular chillers 22 which are arranged into two interconnected arrays 24 and 26 wherein the interconnection is by four water manifolds 28, 30, 32 and 34. Manifold 28 is a chilled water inlet manifold. Manifold 30 is a chilled water outlet manifold. An appropriate title for the drawing illustration of FIG. 1 is "racked modular chiller or heater/chiller". Manifold 32 is a condenser water inlet manifold. Manifold 34 is a condenser water outlet manifold. The information and descriptions included as a part of FIG. 1 are explanatory of what is illustrated all as a part of one embodiment of the present invention. Also included as a part of the FIG. 1 illustration is a racked modular chiller optional pipe chase 36 and an optional factory supplied and field installed manifold 38 to connect multiple modular arrays with an optional enclosure, as illustrated. For an arrangement with a top-mounted supply and return manifold it is contemplated that system 20 may use an optional reverse return, i.e. a third internal pipe. Suitable module racks for receipt of equipment modules such as chillers 22 are illustrated in FIGS. 2 and 3, for example.

FIG. 1 shows the basic external configuration of four (4) multiple module vertical racked packages in a two plus two configured as array 24 and array 26. The space between each array is available for access to componentry from one side or the front of the modular racks. Above the rear fixed piping section 36 are four externally mounted piping systems for condenser water 32 and 34 and chilled water 28 and 30. Further, the refrigeration system can be configured as a chiller with a separate heat rejection device (not shown) or componentry can be included to simultaneously produce chilled water and hot water using condenser heat recovery, depending on the space heating/cooling requirements, or to be used for domestic hot water preheat.

Figure 2:
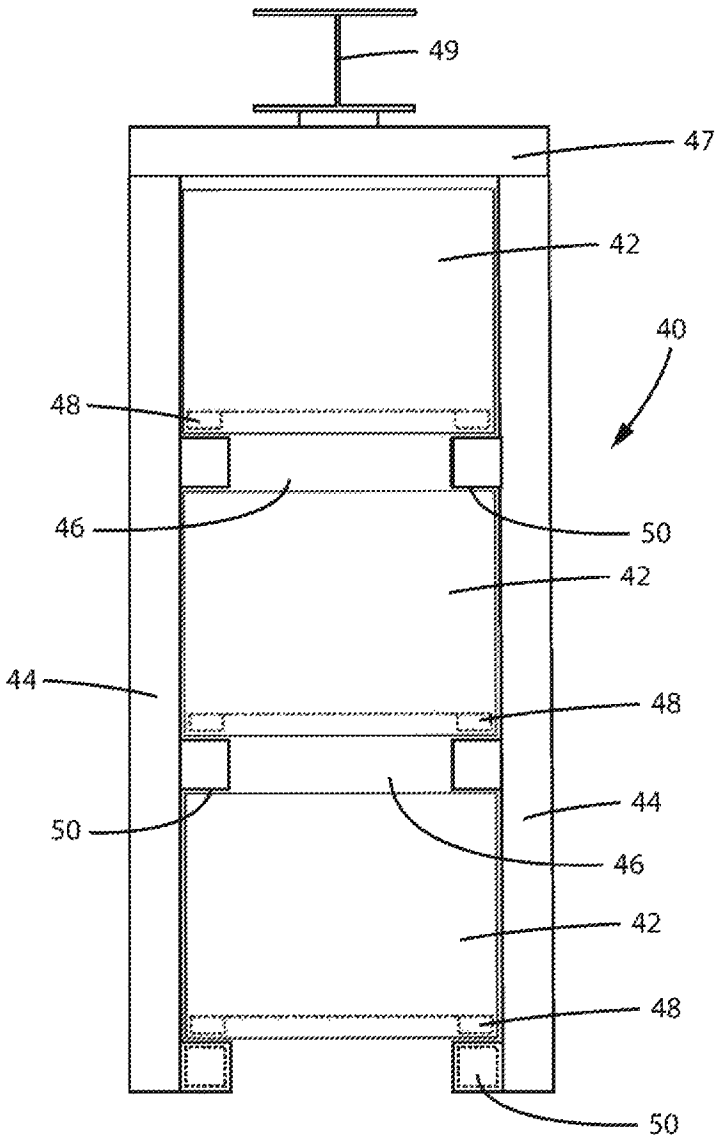
FIG. 2 is a front elevational, diagrammatic illustration of a rack support structure associated with the FIG. 1 modular system receiving modular equipment units.
Figure 3:
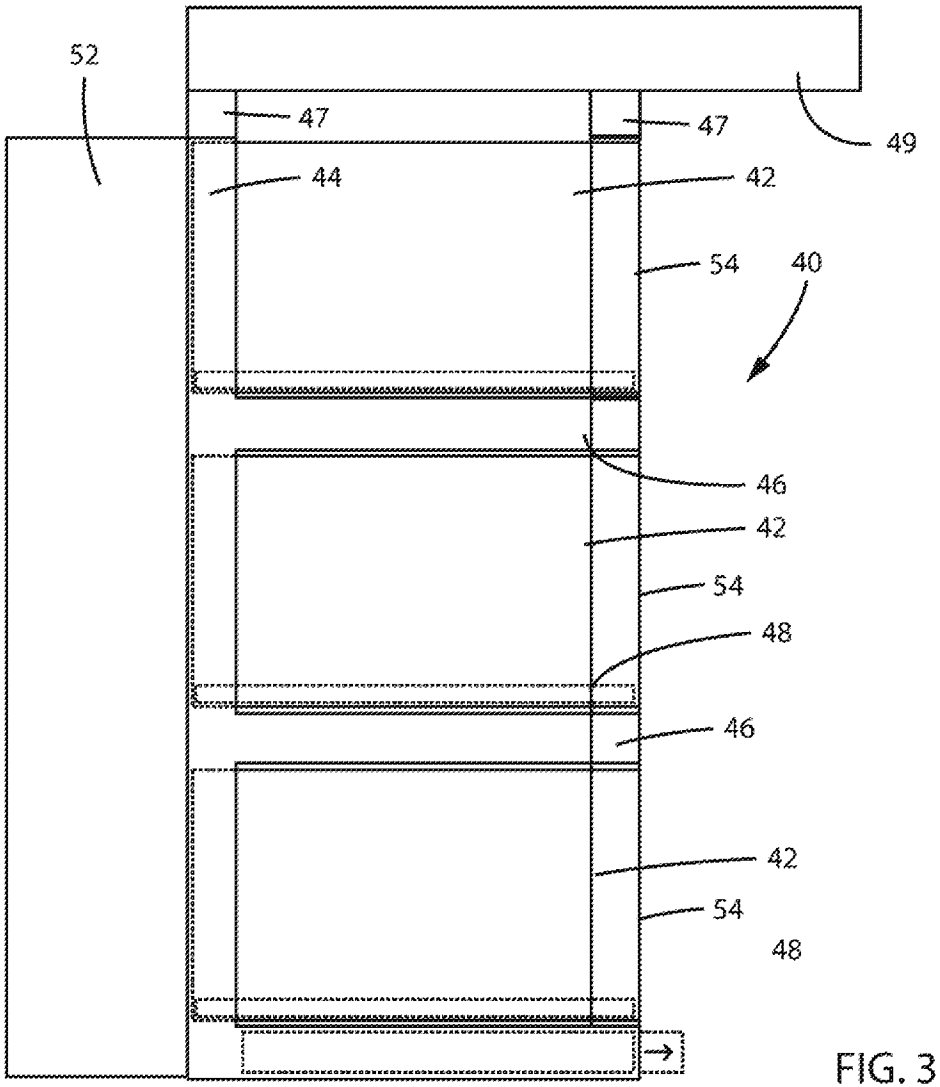
FIG. 3 is a side elevational, diagrammatic illustration of the FIG. 2 rack support structure.

With reference to FIGS. 2 and 3, a suitable storage rack 40 for equipment modules 42 according to the present invention is illustrated. An appropriate title for the drawing illustration of FIG. 2 is "racked modular chiller, heater/chiller, DX or VRV/VRF racked simplex configuration". An appropriate title for the drawing illustration of FIG. 3 is "racked modular chiller, heater/chiller, DX or VRV/VRF racked simplex configuration". In the FIG. 2 arrangement the equipment modules 42 are preferably either chiller racked modules or heater/chiller racked modules. The storage rack 40 includes vertical rack supports 44, horizontal rack supports 46 and slide out rails 48. Horizontal bottom support extensions 50 are used when pulling out or removing a racked equipment module. Further included as a part of the illustrated FIG. 2 system is an optional top support 47 which may have a frame-like construction and an optional crane rail 49 which may have an I-beam construction for trolley and hoist for removal of refrigeration circuit modules.

FIG. 2 shows a unique feature of independent, vertical stacked, removable modules 42 with bottom support tray/rails 48. An elevation view of the front framework 44 and 50 is provided that in this embodiment has three refrigeration cycle racks. Depending on the height of each module and the space height available in the chiller/boiler plant, many more modules of refrigeration cycles could be stacked. A crane rail 49 can be mounted to additional top framework 47 to allow ease of removal of the individual refrigeration trays when mechanized equipment such as forklift is not available. Individual refrigeration trays could then be moved via a four wheel cart in and out of the mechanical room as required. The optional crane rail would normally be mounted from the ceiling, but could also be mounted to a reconfigured framework 47 built to support the weight of the refrigeration trays as they are removed from the framework.

With continued reference to FIG. 3, an optional piping/electrical module 52 is illustrated at the back or rear of storage rack 40. Also shown in FIG. 3 is an optional sound and ventilation package 54. FIG. 3 shows another unique feature of an internal fixed hydronic piping/electrical/control system in fixed chase 52 in this side elevation view of the same three vertical rack modules of refrigeration cycle equipment of FIG. 2. FIG. 3 combines the front framework 44, 46 and 50 with rear framework 52 that includes fixed piping/electrical and control componentry that interfaces with the front refrigeration modules 42. The terminology of "module", "fixed chase" and "framework" are used interchangeably for item 52.

Figure 4:
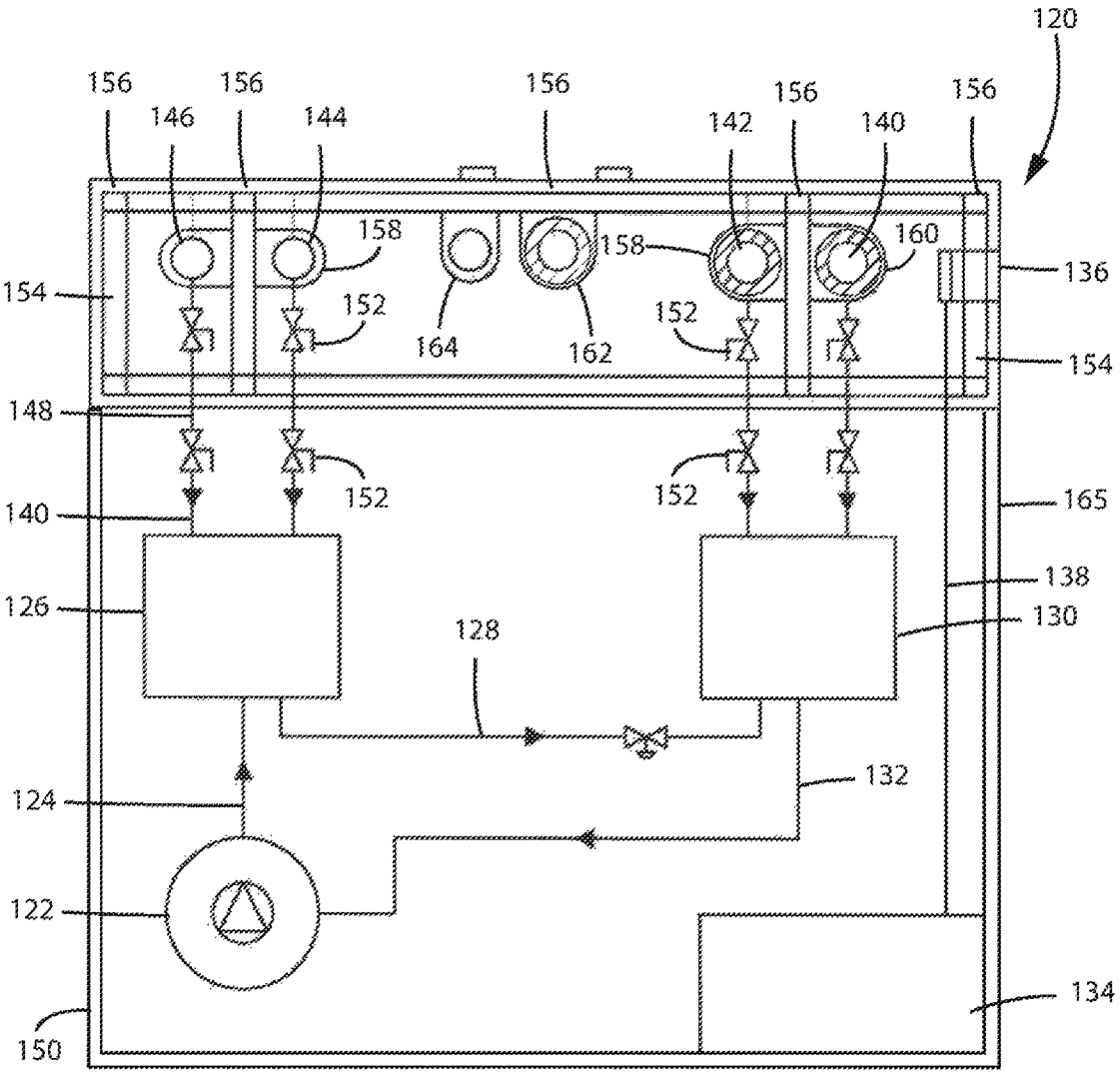
FIG. 4 is a schematic illustration as a plan view of an internal flow network and valving associated with and suitable for a racked modular chiller or heater/chiller according to an embodiment of the present invention.

With reference to FIG. 4 the internal flow system and valving network 120 for a racked modular chiller 22 is illustrated. An appropriate title for the drawing illustration of FIG. 4 is "racked modular chiller or heater/chiller". The disclosed construction is also suitable as a foundation for a racked modular heater/chiller with appropriate changes as would be known to one of ordinary skill in the art. As marked on FIG. 4 with the corresponding reference numbers, the components, conduits and connections of the flow system and valving network 120 include the following as set forth in Table 1:

TABLE 1

| Ref. No. | Description |
|---|---|
| 122 | compressor |
| 124 | hot gas pipe to condenser/heater pipe |
| 126 | brazed plate heat exchanger: condenser |
| 128 | liquid pipe with expansion device |
| 130 | brazed plate heat exchanger: evaporator |
| 132 | suction pipe |
| 134 | starter/control panel |
| 136 | buss bar- alternate for wire whips for main junction box |
| 138 | line voltage from buss bar to starter/control panel |
| 140 | return chilled water in |
| 142 | supply chilled water out |
| 144 | condenser or heating water inlet |
| 146 | condenser or heating water outlet |
| 148 | grooved pipe or flex pipe |
| 150 | rack equipment tray. Sides and cover optional. Acoustical insulation optional. |
| 152 | manual isolation valves. Motorized actuators optional. |
| 154 | piping, electric and control wiring chase |
| 156 | structural chase support |
| 158 | pipe/support hanger |
| 160 | pipe insulation on chilled water piping. Note pipe insulation on condenser with heat recovery options. |
| 162 | optional reverse return supply chilled water piping |
| 164 | optional reverse return supply condenser water piping |
| 165 | front framework |

FIG. 4 shows yet another unique feature of how closing isolation valves 152 and removing flex connector 148, the refrigeration module 150 can be removed from the framework 156 when the flex connector 148 is removed. This allows the complete refrigeration cycle tray 150 to be removed from the framework for easy service access to all componentry. FIG. 4 is a plan view (looking down from above) of both the refrigeration cycle tray 150 and fixed piping/electrical control section 154. The brazed plate heat exchangers 126 and 130 which typically are the most compact type of heat exchanger are shown; however, any other somewhat compact heat exchanger could be used such as shell and tube. The flex pipe 148 also allows slight differentials in alignment between the isolation valves 152 in the fixed rear section 154 and the isolation valves 152 for the removable refrigeration tray 150 in the front framework section 165. Also note that in the case of a simplex rack system with only one multiple module vertical racked modular system, there would be access to three sides of the system if the rear fixed piping chase mounts against a wall. If the vertical system is free-standing, then there could be access on all sides, but in general, it is envisioned that the system will mount against a wall. The rear fixed section includes 154, 156 fixed hydronic piping 140, 142, 144, 146 with attaching hardware 158 and pipe insulation 160 where required and optional "reverse return" piping 162, 164, if required. The rear fixed section also includes an electrical power supply buss bar, wiring harness or wiring whip with a disconnecting device for the interconnecting wiring 138 to the front section starter/control panel 134 that mounted with the refrigeration circuit 122, 124, 126, 128, 130, 132, on the refrigeration tray 150. Some isolation valves 152 could be automated for the control system, although standard control components for flow, temperature and pressure are not shown.

Figure 5B:
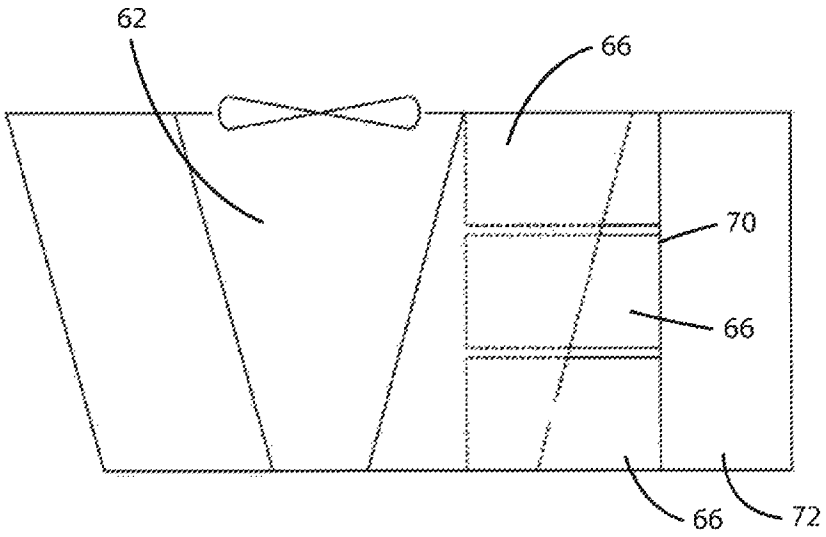
FIG. 5B is an elevational, diagrammatic illustration of a vertical racked storage rack arrangement.
Figure 5A:
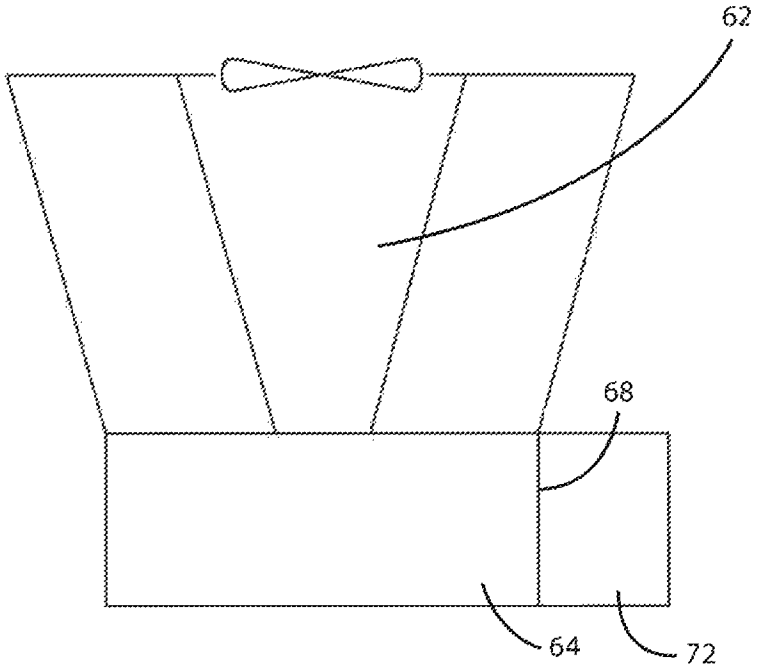
FIG. 5A is an elevational, diagrammatic illustration of a horizontal racked storage rack arrangement.

With reference to the two arrangements of FIGS. 5A and 5B, a wet/dry air cooled condenser 62 is illustrated as mounted above an equipment module 64 in FIG. 5A. An appropriate title for the drawing illustrations of FIGS. 5A and 5B is "dry or wet/dry air cooled cooler or condenser with racked modular chiller or condensing unit". In FIG. 5B, the condenser 62 is mounted to the end or side of an equipment module 66. A horizontal rack 68 is used in FIG. 5A for a plurality of modules 64. In FIG. 5B a vertical rack 70 is used for a plurality of modules 66. As would be understood relative to the horizontally racked description for FIG. 5A, the additional modules 64 are arranged side-by-side into the plane of the paper. In the FIG. 5B arrangement, as illustrated, the modules 66 are arranged in a vertical stack. In the exemplary embodiments of FIGS. 5A and 5B, the equipment modules 64 and 66 are racked compressor cooling or heat/recovery modules. Optionally, each arrangement (FIGS. 5A and 5B) may include a piping package 72.

Figure 6B:
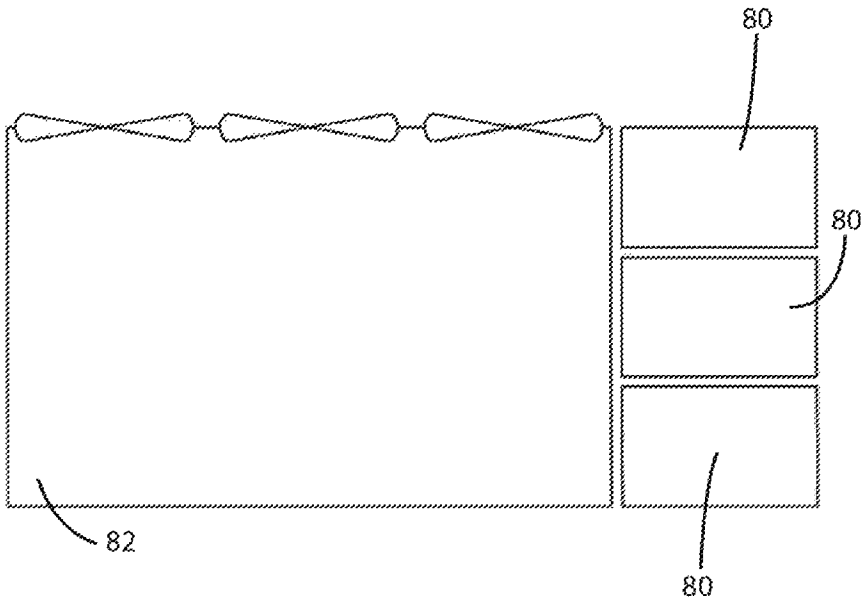
FIG. 6B is a side elevational, diagrammatic illustrations of the FIG. 5B storage rack arrangement.
Figure 6A:
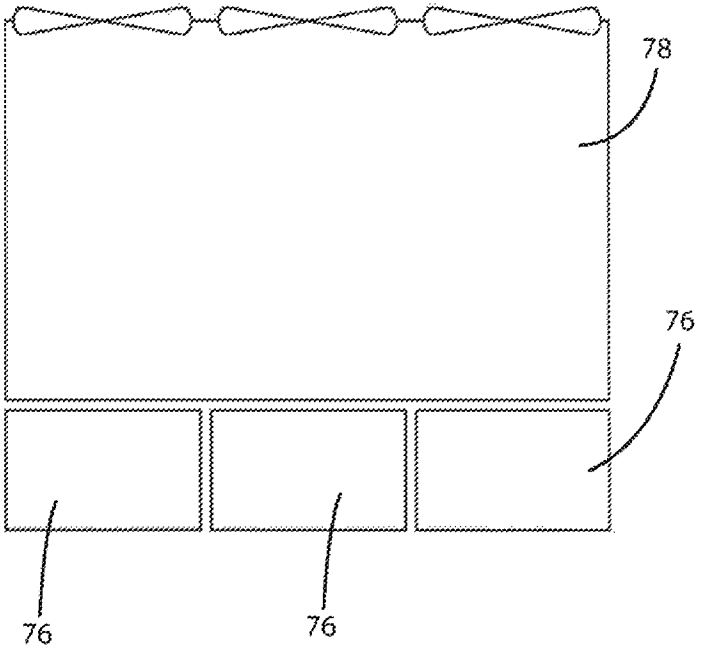
FIG. 6A is a side elevational, diagrammatic illustrations of the FIG. 5A storage rack arrangement.

With reference to FIGS. 6A and 6B two other variations to what is disclosed in FIGS. 5A and 5B are illustrated. An appropriate title for the drawing illustrations of FIGS. 6A ends 6B is "dry or wet/dry air cooled cooler or condenser with racked modular chiller or condensing unit". In FIG. 6A the equipment modules 76 are mounted beneath the cooler or condenser 78 in a horizontal rack. In FIG. 6B the equipment modules 80 are mounted at the end of the cooler or condenser 82. In the exemplary embodiments of FIGS. 6A and 6B the selected cooler or condenser 78, 82 is a dry or wet/dry air cooled cooler or condenser. In these two exemplary embodiments the selected equipment modules 76, 80 are racked compressor cooling or heat/recovery modules.

FIGS. 6A and 6B take the concepts of the vertical rack system and apply it to an outdoor cooler or condensing unit with either a vertical rack mount at either of the cased face ends of the cooler or condenser (FIG. 6B). FIG. 6A reimagines the multiple rack concept in a horizontal configuration, in this case with a horizontal rack system under the entire length of the condensing unit/cooler 78 for indoor use. In the cooler configuration, this packaged unit could be used for winter "free cooling" when suitably cold ambient air is available and the cooler only (i.e. no compressor operation) can reject all heat and supply cold water directly to the cooling load.

Figure 7:
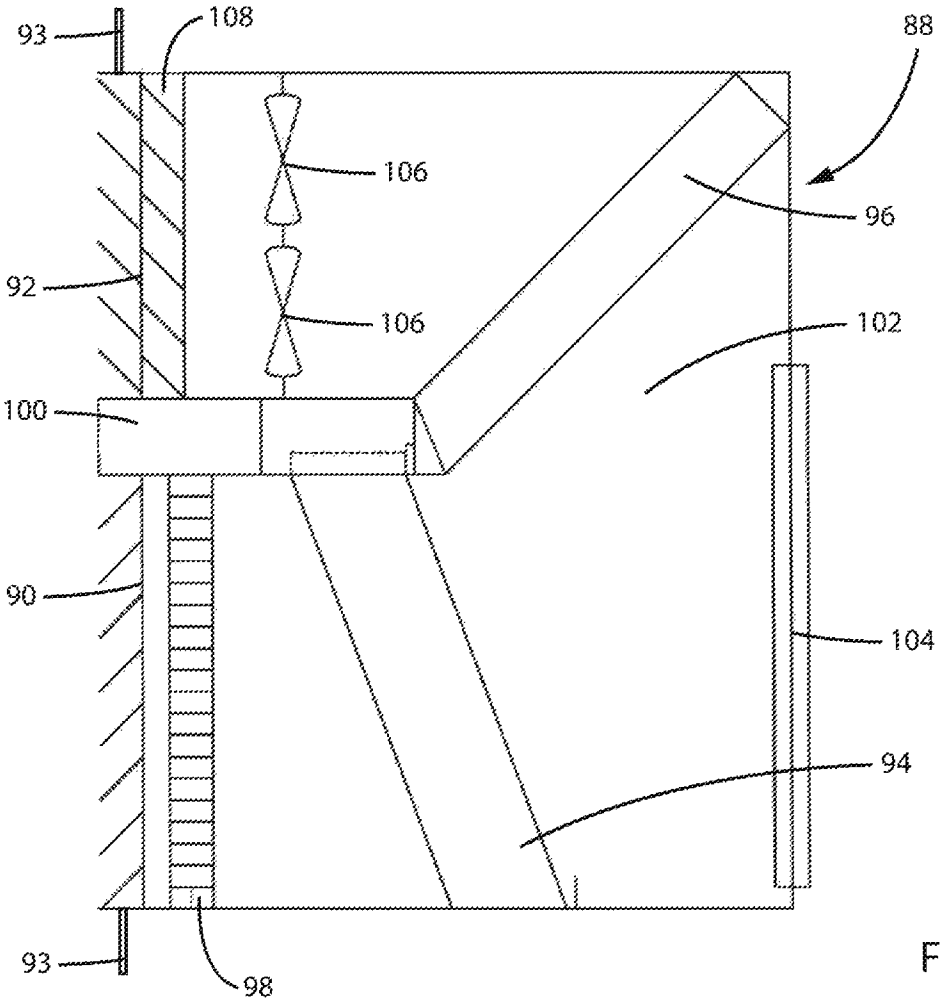
FIG. 7 is a side elevational, diagrammatic illustration of a "through the wall" HVAC heat rejection system for residential and light commercial applications according to another embodiment of the present invention.

With reference to FIG. 7 a "through the wall" heat rejection/heat absorption system 88 is illustrated. The intended application is for a residential or light commercial structure. Air inlet louvers 90 and air outlet louvers 92 are used as a part of the structure whose outside wall 93 is shown. Included as a part of system 88 is an adiabatic precooler 94 and a dry cooler or condenser coil 96. Also included as a part of system 88 is a filter/off season cap 98, an adiabatic water distribution access panel 100, a plenum 102, a plenum access panel 104, a fan section 106 and motorized discharge dampers 108.

FIG. 7 shows a dry or wet/dry cooler or condenser that would be sized for smaller residential and light commercial systems. This is a modular, horizontal, blow through unit and multiple side-by-side units could be joined together to provide increased capacity. FIGS. 7-10 all show indoor coolers or condenser that share similar types of components, but with different configurations depending on the amount and type of through the wall space available and heat rejection capacity required. It is envisioned that the heat rejection describe in FIG. 7 could be installed in place of a large window with cool ambient air entering the lower grille, passing through a screen or filter 98 then adiabatic air cooler 94 then through the cooler or condenser coil 96 and into the fan(s) 106, discharging through the upper grille.

Figure 8:
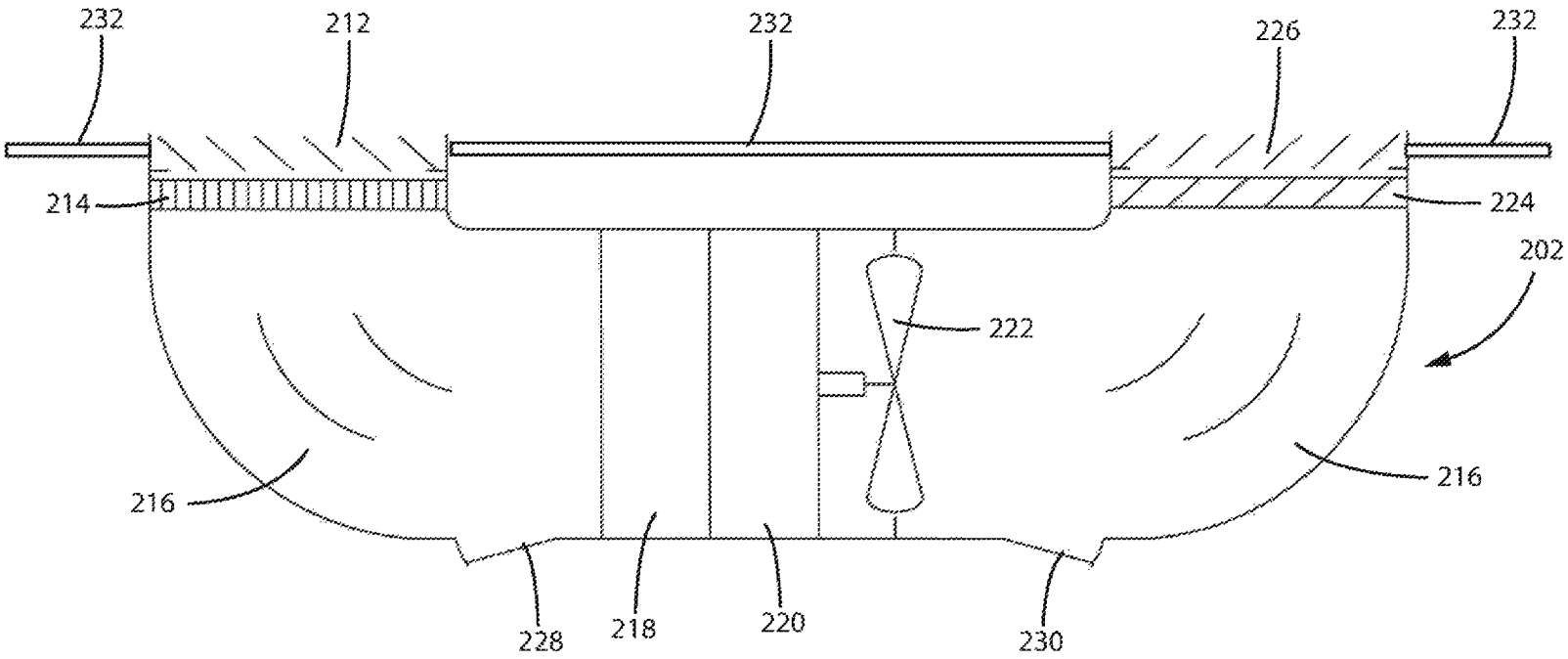
FIG. 8 is a plan view, diagrammatic illustration of a "through the wall" multi-circuit heat rejection/heat absorption system of standard capacity according to another embodiment of the present invention.
Figure 9:
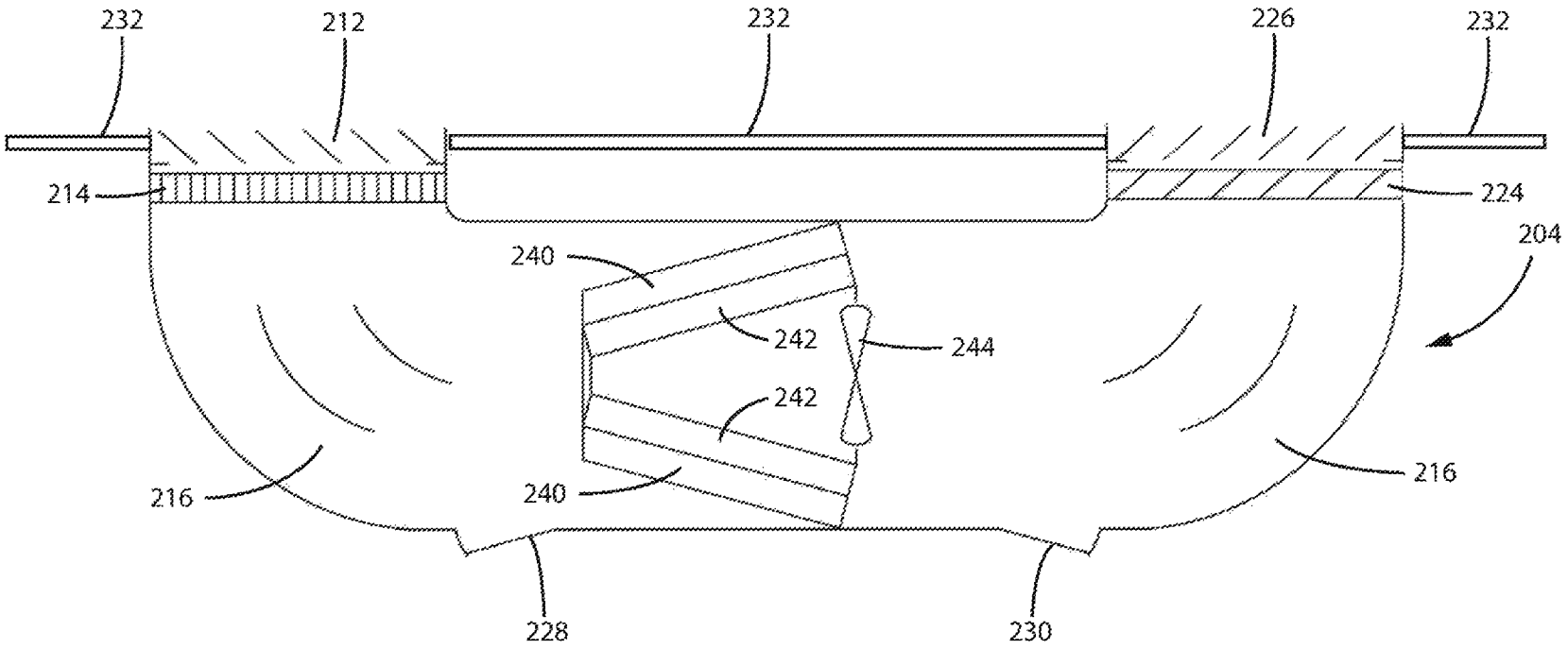
FIG. 9 is a plan view, diagrammatic illustration of another "through the wall" variation with a higher capacity compared to the FIG. 8 system, based in part on the FIG. 8 system construction.
Figure 10:
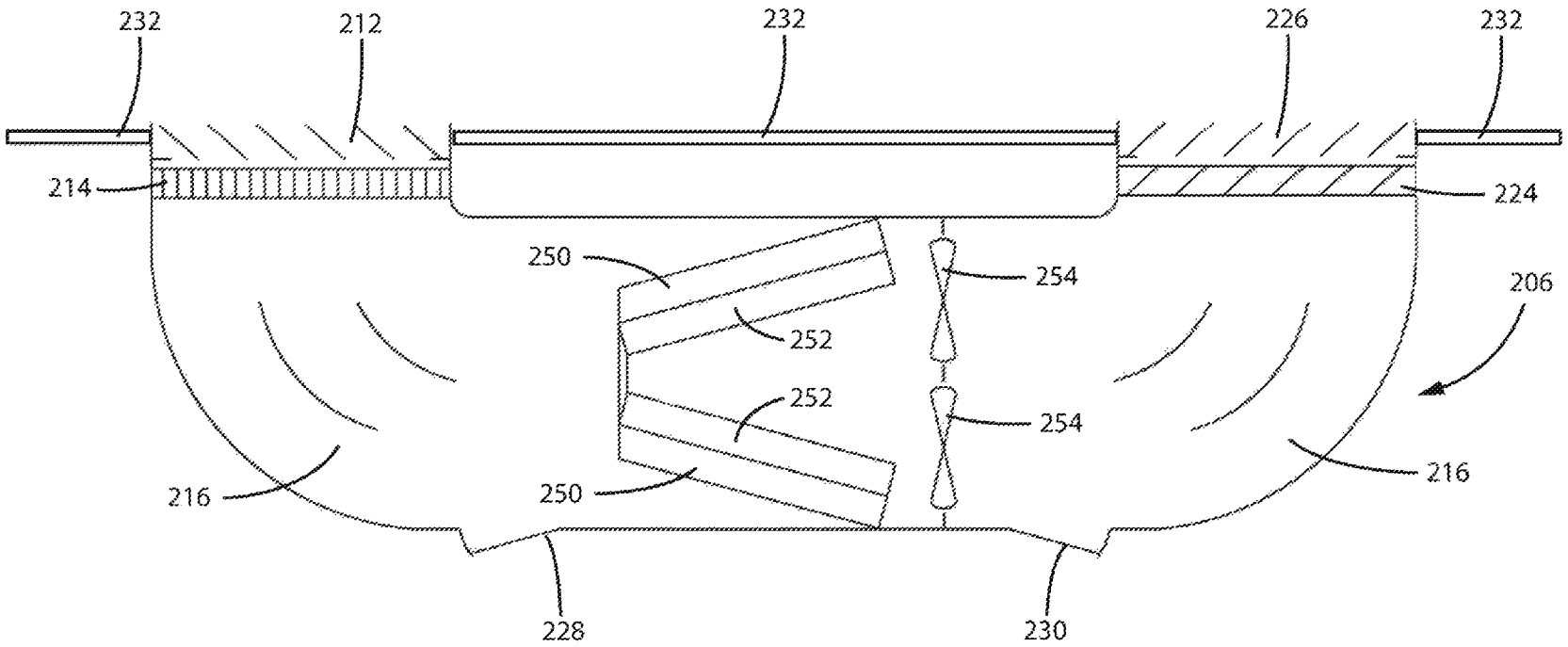
FIG. 10 is a plan view, diagrammatic illustration of another "through the wall" variation with a higher capacity compared to the FIG. 9 system, based in part on the FIG. 8 system construction.

With reference to FIGS. 8, 9 and 10 there are three variations of essentially the same basic construction of a "through the wall" multi-circuit heat rejection/heat absorption system. System 202 of FIG. 8 represents a construction which is best described as a system of "standard" capacity. System 204 of FIG. 9 is best described as a system of "higher" capacity. System 206 of FIG. 10 is best described as a system of "highest" capacity. Noting that terms such as "higher" and "highest" are relative terms, the reference point for these terms is the design and construction of system 202 of FIG. 8 as being the base or "standard". The "higher" and "highest" terms are thus used in reference to the design and construction of systems 202, 204 and 206 with system 202 being the reference point. FIG. 11 illustrates one design option for the layout and arrangement of an air outlet louver 208 and of an air inlet louver 210 which would be suitable for use with or as part of the system constructions illustrated in FIGS. 8, 9 and 10. With continued reference to FIG. 8 other components and structures of system 202 include air inlet louver 212, operational filter/off-season insulated cap 214, transition with turning veins 216, adiabatic precooler 218, condenser 220, high-efficiency ECM fans 222, high-performance on/off damper 224, air outlet louver 226, access door inlet section and adiabatic precooler 228, access door air outlet section and hinged fan access panel and coil 230. In the exemplary embodiment the condenser 220 is an hydronic heat rejecter heat absorber, DX-VRF/VRV heat rejection air cooled condenser. The outside wall of the building where system 202 is installed is represented by reference number 232.

The differences between the systems 202, 204 and 206 of FIGS. 8, 9 and 10, respectively, are found in the design of the adiabatic precooler, the condenser and the fans. In the FIG. 8 system 202, these components are reference numbers 218, 220 and 222, respectively. The FIG. 9 system 204 includes adiabatic precooler 240, condenser 242 and fans 244. All other components and structures of system 204 are the same as system 202 and the same reference numbers are used. The FIG. 10 system 206 includes adiabatic precooler 250, condenser 252 and fans 254. All other components and structures a system 206 are the same as system 202 and the same reference numbers are used.

FIG. 8 is envisioned to replace and sit between two windows that have been replaced by two grilles 212 and 226. Other than larger media 218, coil 220, and fan 222 the componentry is similar. FIG. 9 is similar to FIG. 8, but uses large media 240 and coil 242 banks to supply higher capacity. FIG. 10 builds on FIG. 9 to maximize the capacity that an indoor cooler with a "V" coil can achieve. The coil maximizes the horizontal and vertical space available and uses a high capacity fan wall system to move the maximum amount of air through the adiabatic media and cooler or condenser coil.

Figure 11B:
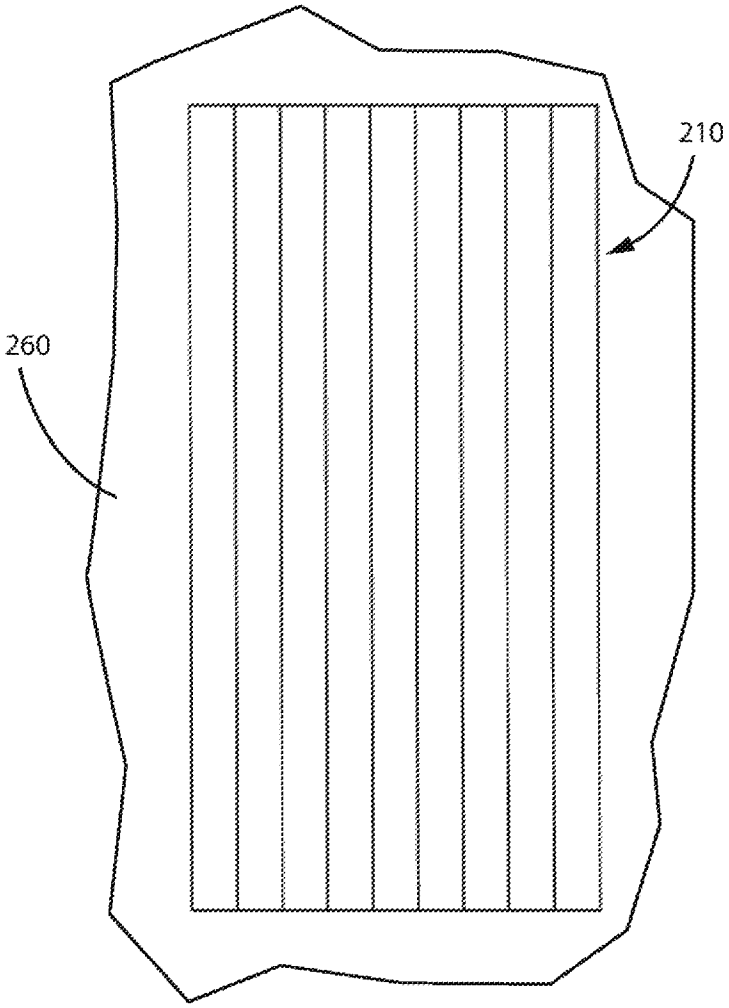
FIG. 11B is an elevational view, diagrammatic illustration of suitable air inlet louvers which are suitable for use with any of the FIG. 8, FIG. 9 and/or FIG. 10 constructions.
Figure 11A:
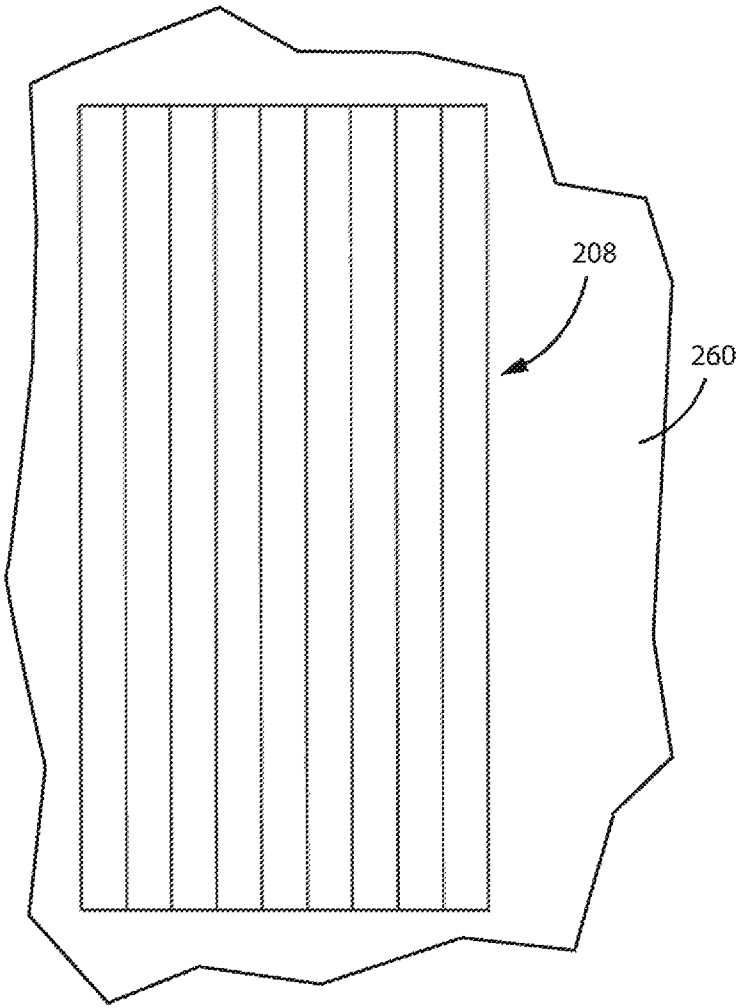
FIG. 11A is an elevational view, diagrammatic illustration of suitable air outlet louvers which are suitable for use with any of the FIG. 8, FIG. 9 and/or FIG. 10 constructions.

With further reference to the air outlet louver 208 of FIG. 11A and the air inlet louver 210 of FIG. 11B, the face of the building into which these louvers are installed is identified by reference number 260. FIGS. 11A and 11B show an external building view of the air inlet and outlet louvers in FIGS. 8 and 9, for example.

Figure 12C:
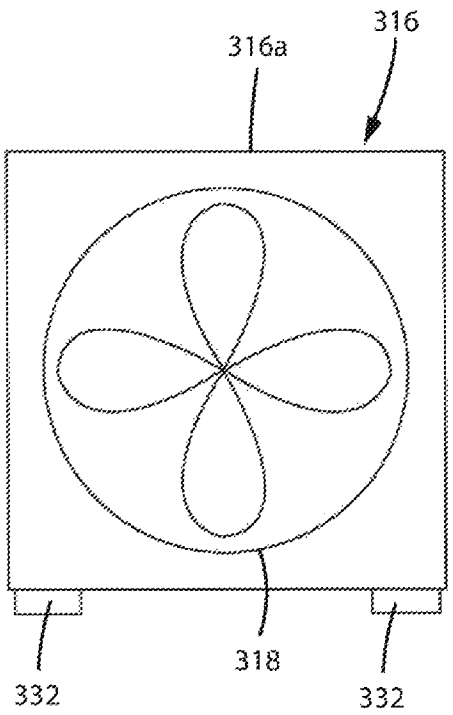
FIG. 12C is a front elevational view of the FIG. 12A system.
Figure 12B:
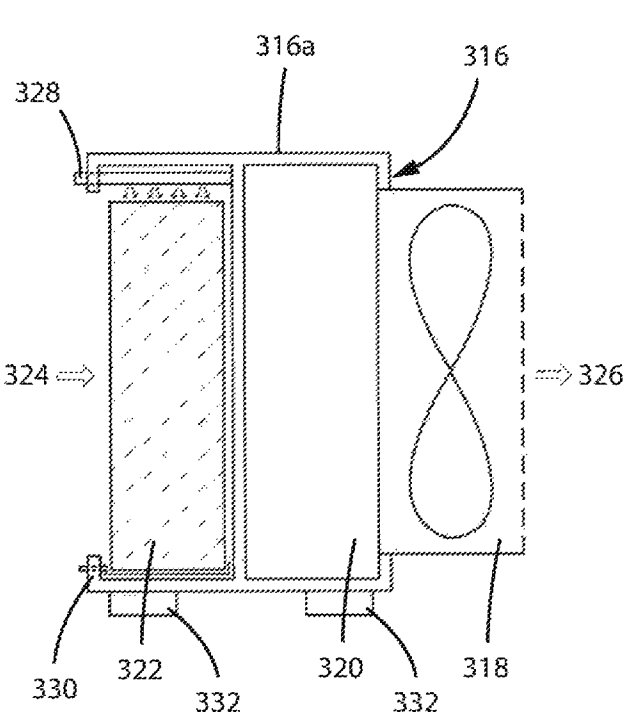
FIG. 12B is a side elevation view of the FIG. 12A system.
Figure 12A:
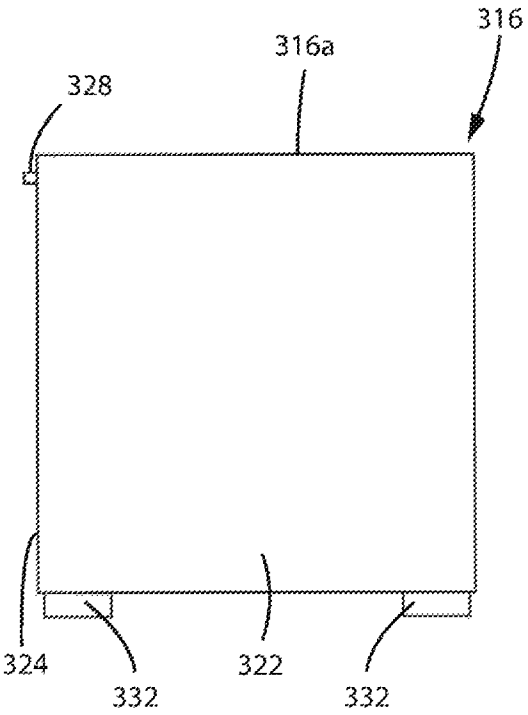
FIG. 12A is a rear elevational view, diagrammatic illustration of a CGX residential-hybrid heat rejection/heat absorption system with a finned hydronic coil according to another embodiment of the present invention.

With reference to FIGS. 12A, 12B and 12C a CGX residential-hybrid system (wet/dry) cooler 316 within a casing 316*a* is illustrated. FIG. 12A is a rear view of cooler 316. FIG. 12B is a side view of cooler 316. FIG. 12C is a front view of cooler 316. The three principal portions of cooler 316 include an ECM fan assembly 318, a finned hydronic coil 320, and a "wet" adiabatic precooler assembly 322. Also included as a part of cooler 316 is a location of inlet 324 for entering ambient air, a location 326 for discharge air, a water inlet 328 for adiabatic media, an adiabatic catchment pan 330 with drain to the surrounding ground (yard) and support feet 332. FIGS. 12A-12C illustrate a "hybrid" wet/dry cooler that can be applied to a CGX geothermal loop system. Cooler 316 is applied to a residential system that also uses geothermal loop for heat rejection/heat absorption. The cooler described in FIGS. 12A-12C is meant to add additional heat rejection capacity for warm weather cooling by working in series and after the geothermal loop to additional cooling to the loop water before it enters a condenser of the geothermal heater/chiller.

The system of FIGS. 12A-12C in the form of cooler 316 is a representative example of the type of equipment which can be modularized according to the present invention. Once modularized, a plurality of coolers 316, as modules, can be installed, either horizontally or vertically, in a racking system or framework as described herein by the exemplary embodiments of the present invention.

Figure 13:
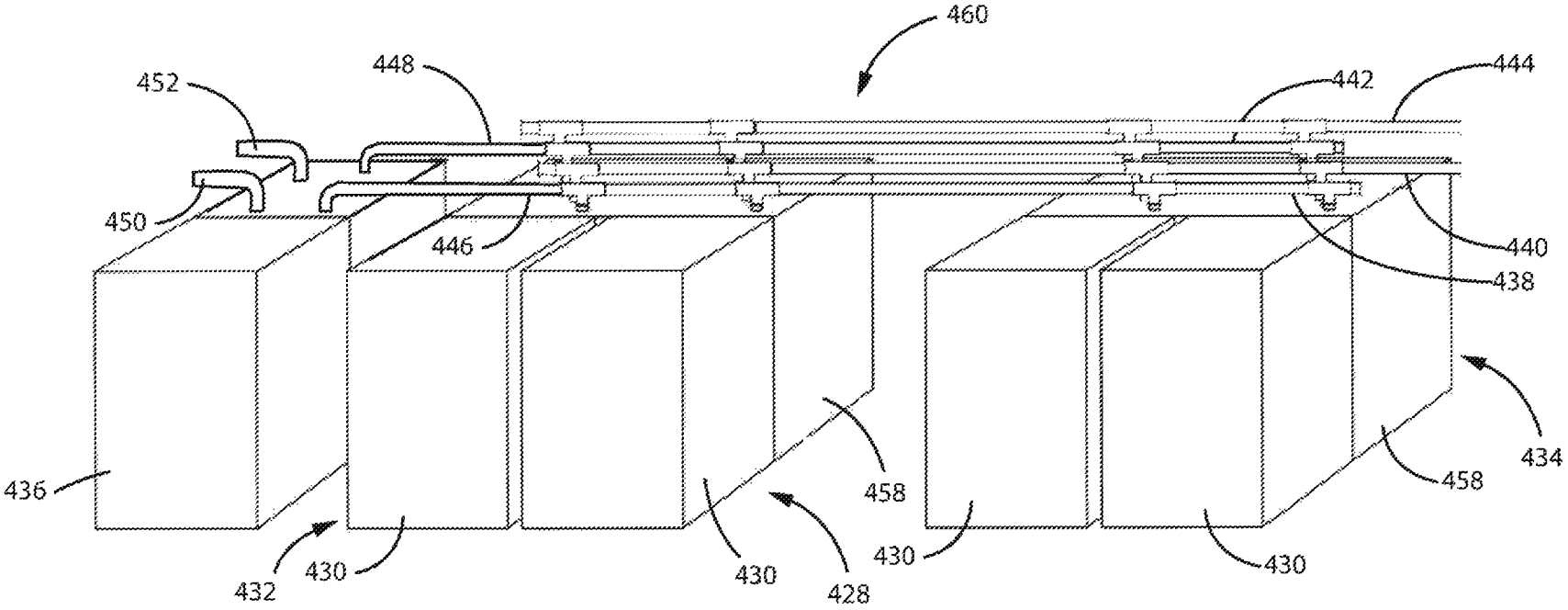
FIG. 13 is a perspective view, diagrammatic illustration of a modular system for heating and/or cooling requirements including racked modular chillers and a pumping module according to an exemplary embodiment of the present invention.

With reference to FIG. 13 there is illustrated a racked modular system 428 which includes a plurality of racked modular chillers 430 which are arranged into two interconnected arrays 432 and 434. Also included is a part of the system 428 architecture is a chiller and condenser pumping module 436. The interconnection for arrays 432 and 434 and for pumping module 436 is by way of four water manifolds 438, 440, 442 and 444. Manifold 438 is an optional chilled water inlet manifold. Manifold 440 is a chilled water outlet manifold. Manifold 442 is a condenser water inlet manifold. Manifold 444 is a condenser water outlet manifold. The additional piping illustrated in FIG. 13 includes pumping module to chiller inlet piping 446, pumping module to condenser inlet piping 448, system chiller return piping to pumping module 450 and system condenser return piping to pumping module 452. Also included as a part of system 428 is a racked modular chiller rear pipe chase 458 and an optional factory supplied and field installed manifold 460 to interconnect multiple module arrays.

FIG. 13 builds on FIG. 1 with a four-rack, two-array chiller or heater/chiller with four modules 430 arranged in the two arrays 428 and 430. Another vertical framework is added which contains the pumping system 436. This could include the chilled water pump, condenser water pump if required, air separators, expansion tanks, sensors, valves, etc. This system would also connect to the piping manifold system that occupies the space above all the modules. The piping manifold system 460 includes manifolds or conduits 438, 440, 442 and 446, 448, 450 452.

Figure 14:
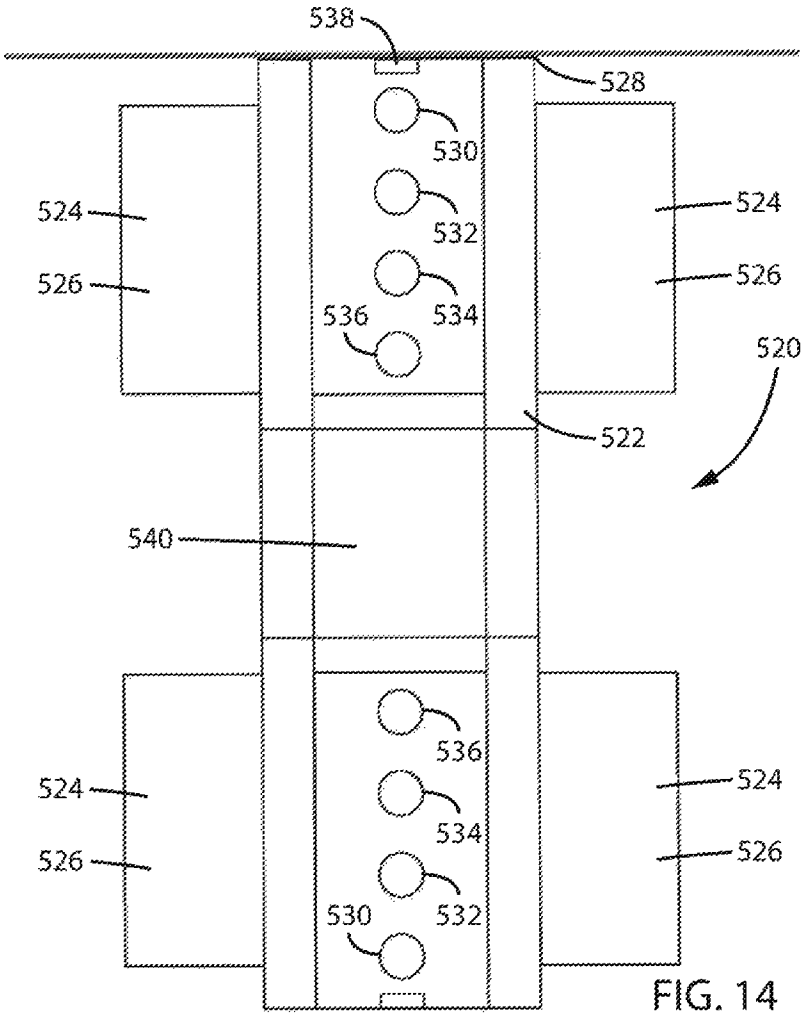
FIG. 14 is a plan view, diagrammatic illustration of a racked modular heating system incorporating condensing and/or electrical boilers according to another embodiment of the present invention.

With reference to FIG. 14 a racked modular system 520 for condensing boilers or for electrical boilers is illustrated as a plan view. The component parts and structures which are part of system 520 include a support super structure 522, a high-efficiency condensing boiler 524 and a vertical rack structure 526 for stacking in a vertical direction two, three or more individual units. As an optional construction an electric boiler may be used instead of the condensing boiler 524. Further included as a part of system 520 is its location of attachment 528 to a structural wall, flue piping 530, combustion air piping 532, inlet return water 534, discharge supply water 536, a power and control wiring chase 538 and access/spacer structure 540.

FIG. 14 is a plan view (looking down) at a back-to-back boiler 524 vertical racking system 522 that holds multiple wall-hung condensing or electric boilers that are stacked two, three or more units 526 high depending on ceiling height between the floor and the ceiling. In addition to the racking for the boilers on the left and right side, there is a central common chase area that contains exhaust flue 530, makeup combustion air piping 532, and inlet 534 and discharge 536 hot water piping. In addition, the chase accommodates electrical power and control wiring 538. There is a spacer area between the vertical stacks of boilers 540 to accommodate limited service access.

Figure 15:
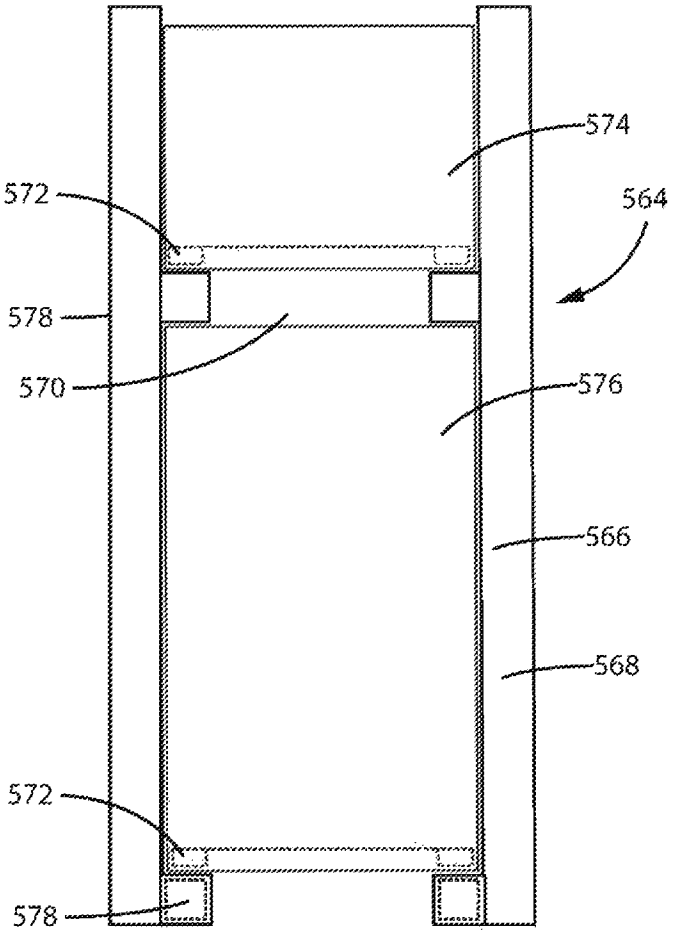
FIG. 15 is a front elevational view, diagrammatic illustration of a rack support structure associated with the modular systems disclosed herein according to the various embodiments of the present invention.

With reference to FIG. 15 a racked modular pumping system 564 is illustrated. System 564 is constructed and arranged for a remote air cooled condenser chiller and/or for heating systems. The rack 566 includes vertical rack supports 568, horizontal rack supports 570 and slide out rails 572. Also included is a chiller or heating pump and trim rack module 574 and a hydronic specialty rack module 576. In the exemplary embodiment the hydronic specialty rack module 576 is or includes an air separator and expansion tank. Also included as a part of system 564 is a horizontal bottom support extension 578 to be used when pulling out or removing a rack module.

FIG. 15 gives a front view of the vertical rack 566 pumping/hydronic specialty rack for pumps 574 and hydronic specialties 576 that could be used for either chilled and/or heating water pumping for an unit that uses a remote air cooled condenser. There is no requirement for pumping with a remote air cooled or wet/dry condenser.

Figure 16A:
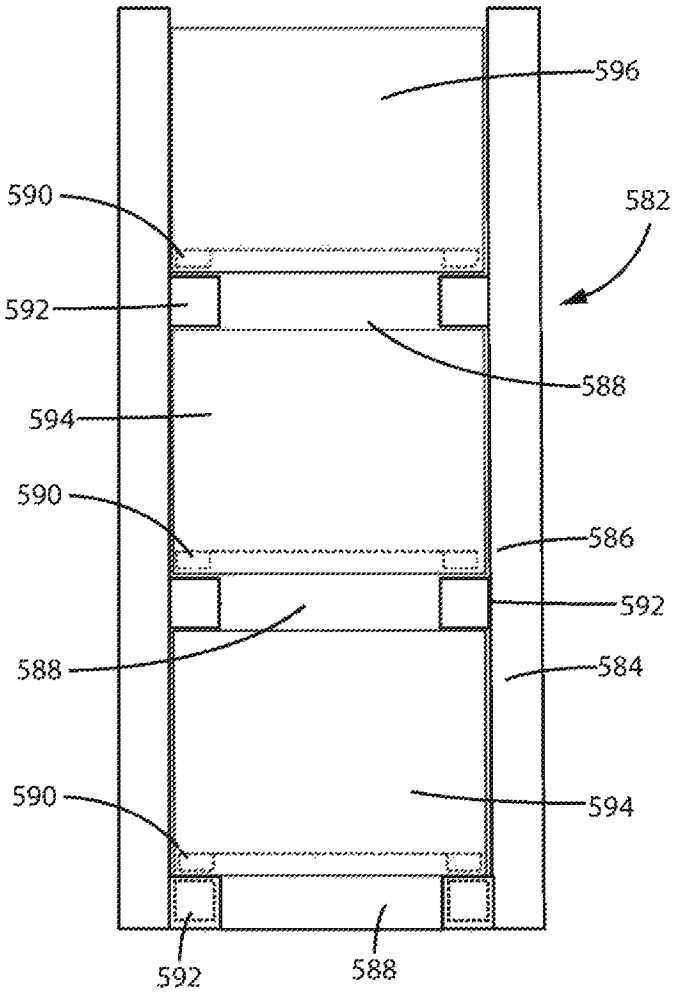
FIG. 16A is a front elevational view, diagrammatic illustration of a rack support structure associated with the modular systems disclosed herein according to the various embodiments of the present invention.

With reference to FIG. 16A a racked modular pumping system 582 is illustrated. System 582 is constructed and arranged for water cooled chillers, heater/chillers and/or heating systems. The rack 584 includes vertical rack supports 586, horizontal rack supports 588 and slide out rails 590. Also included as a part of system 582 is a horizontal bottom support extension 592 to be used when pulling out or removing a rack module and air separator modules 594. In the exemplary embodiment each air separator module 594 is or includes a remote expansion tank. The third module 596 as a condenser or heating pump and trim rack module. FIG. 16A shows a different way to configure the pumping system for a three module vertical rack pumping system. This system would have separate racks for the evaporator pump and the condenser pump and another rack just for the air separator. The expansion tanks could be mounted outside the rack or the three modules shown could be moved up vertically and the expansion tanks could be mounted in a taller bottom module of this vertical racking system. The FIG. 16B system 598 builds on the vertical three refrigeration tray rack of earlier embodiments by maintaining the bottom tray 602 for a chiller or heater/chiller module. The middle module 604 is the pumping system with air separation and depending on the space available in 604 the expansion tank and auto glycol feeder could be mounted in 604 or remotely. The top module holds the boiler 606 with the exhaust flue and combustion air piping above 606 and hydronic and condensate piping below 606 in the pumping system module 604. The system described in FIG. 16B would be for residential or small commercial projects and refrigeration cycle rack 602 (i.e. tray) could be water cooling or use a remote air cooled condenser as described in FIGS. 17A-C.

System 598 also includes the following structures, features and components, vertical rack supports 599, horizontal rack support 600, horizontal bottom support extension used when pulling out or removing a rack module 601, slide out rails 603, slide out rails 605 and slide out rails 607.

Figure 17C:
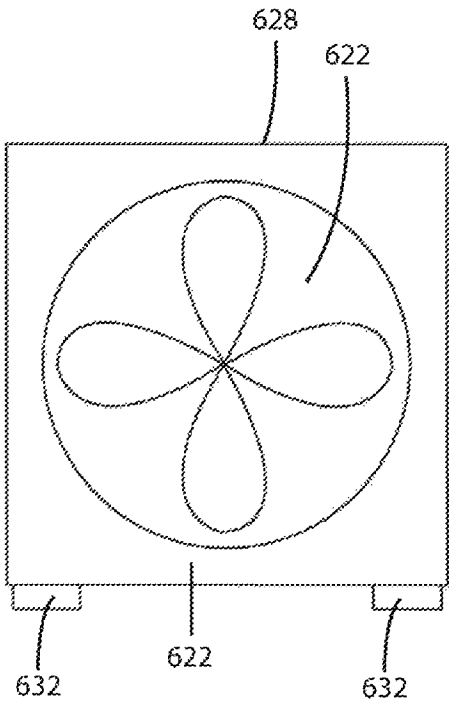
FIG. 17C is a front elevational view, diagrammatic illustration of the FIG. 17A system.
Figure 17B:
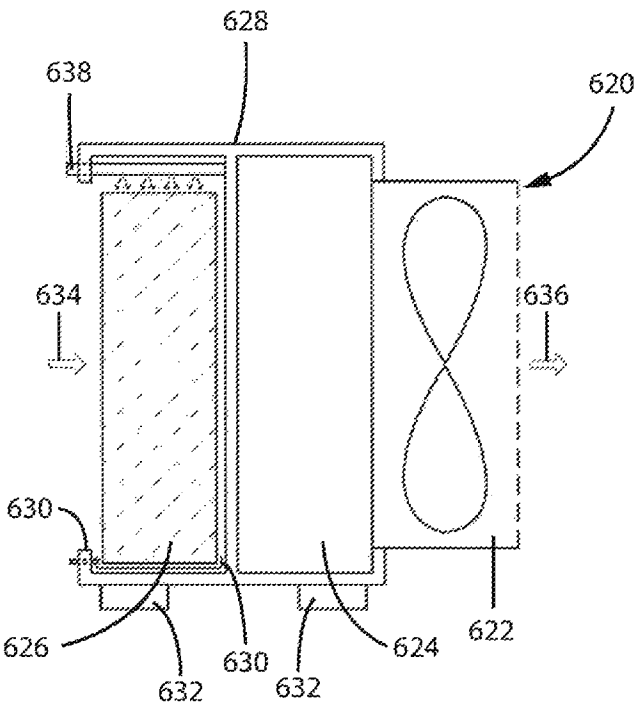
FIG. 17B is a side elevational view, diagrammatic illustration of the FIG. 17A system.
Figure 17A:
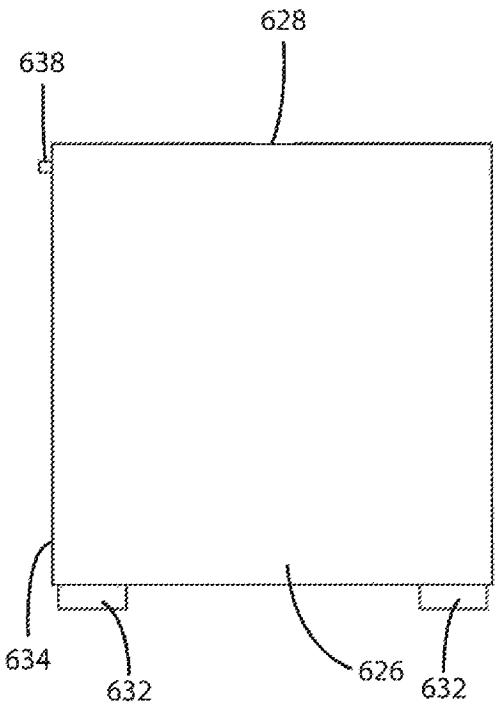
FIG. 17A is a rear elevational view, diagrammatic illustration of a smaller system with a "wet" adiabatic precooler assembly according to another embodiment of the present invention.

With reference to FIGS. 17A, 17B and 17C a racked modular system 620 is illustrated. System 620 is constructed and arranged with a slightly smaller or scaled-down size relative to the other systems described herein as a part of the present invention. System 620 is constructed and arranged for a wet/dry cooler or condenser. The three primary components include an ECM fan assembly 622, a cooler or condenser 624 and a "wet" adiabatic precooler assembly 626. Also included as a part of system 620 is a casing 628, adiabatic catchment pan 630 with the drain to the ground (yard) and support feet 632. Reference number 634 denotes the location of entering ambient air. Reference number 636 denotes the location of discharge air. Reference number 638 denotes the water inlet for adiabatic media.

Figure 16B:
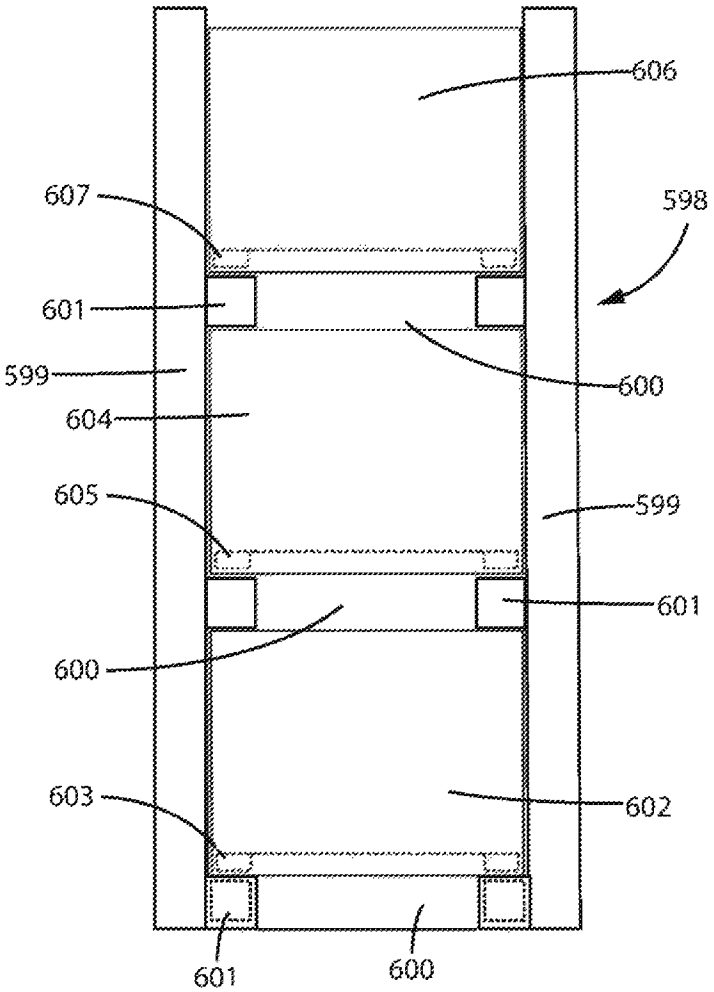
FIG. 16B is a front elevational view, diagrammatic illustration of a rack support structure associated with the modular systems disclosed herein according to the various embodiments of the present invention.

FIGS. 17A, 17B and 17C detail the key components in an outdoor wet/dry cooler or condenser which would be applied with residential or light commercial systems as in FIG. 16B. Ambient air enters the unit 634 and passes first through the "wet" adiabatic precooler media 626 where the air is cooled approaching the wet bulb temperature. Air next enters the hydronic cooler 624 or refrigerant condenser coil where heat is transferred from coil 624 by the fan 622, discharging back to the ambient air 636.

The system of FIGS. 17A-17C in the form of system 620 is a representative example of the type of equipment which can be modularized according to the present invention. Once modularized, a plurality of systems 620, as modules, can be installed, either horizontally or vertically, in a racking system or framework as described by the exemplary embodiments of the present invention.

Figure 18:
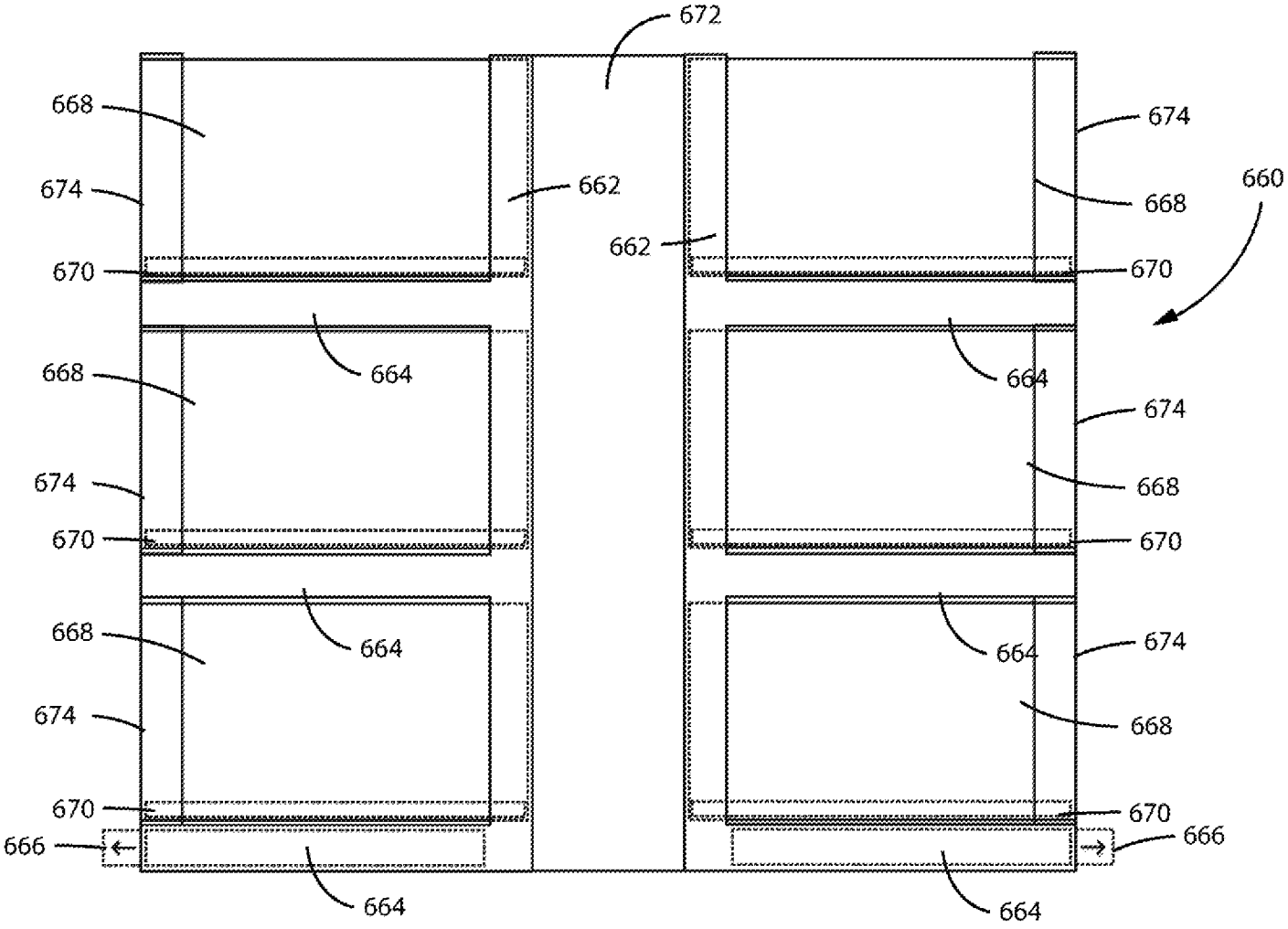
FIG. 18 is a front elevational, diagrammatic illustration of a racked, back-to-back configuration according to another embodiment of the present invention.

With reference to FIG. 18, system 660 is best described as a racked modular chiller, heater/chiller, DX or V RV/VRF with a racked back-to-back construction. The structures, features and components of system 660 are set forth in the following Table 2:

TABLE 2

| Ref. No. | Description |
|---|---|
| 662 | vertical rack supports |
| 664 | horizontal rack supports |
| 666 | horizontal bottom support extension used when pulling out or removing a rack module |
| 668 | chiller or heater/chiller racked modules |
| 670 | slide out rails |
| 672 | optional piping/electrical module |
| 674 | optional acoustical sound and ventilation packages |

FIG. 18 is a derivation of FIG. 3 arranging duplex, modular, vertical stack refrigeration modules with one middle section pipe chase 672 vertical rack installed to the three outside in a back-to-back, left and right configuration. The two arrays are separated by the pipe chase (i.e. module 672). This configuration would be used for maximum capacity in minimum square foot space. FIG. 18 introduces a way to increase capacity depending on the width/length of the central plant and height available.

Figure 19:
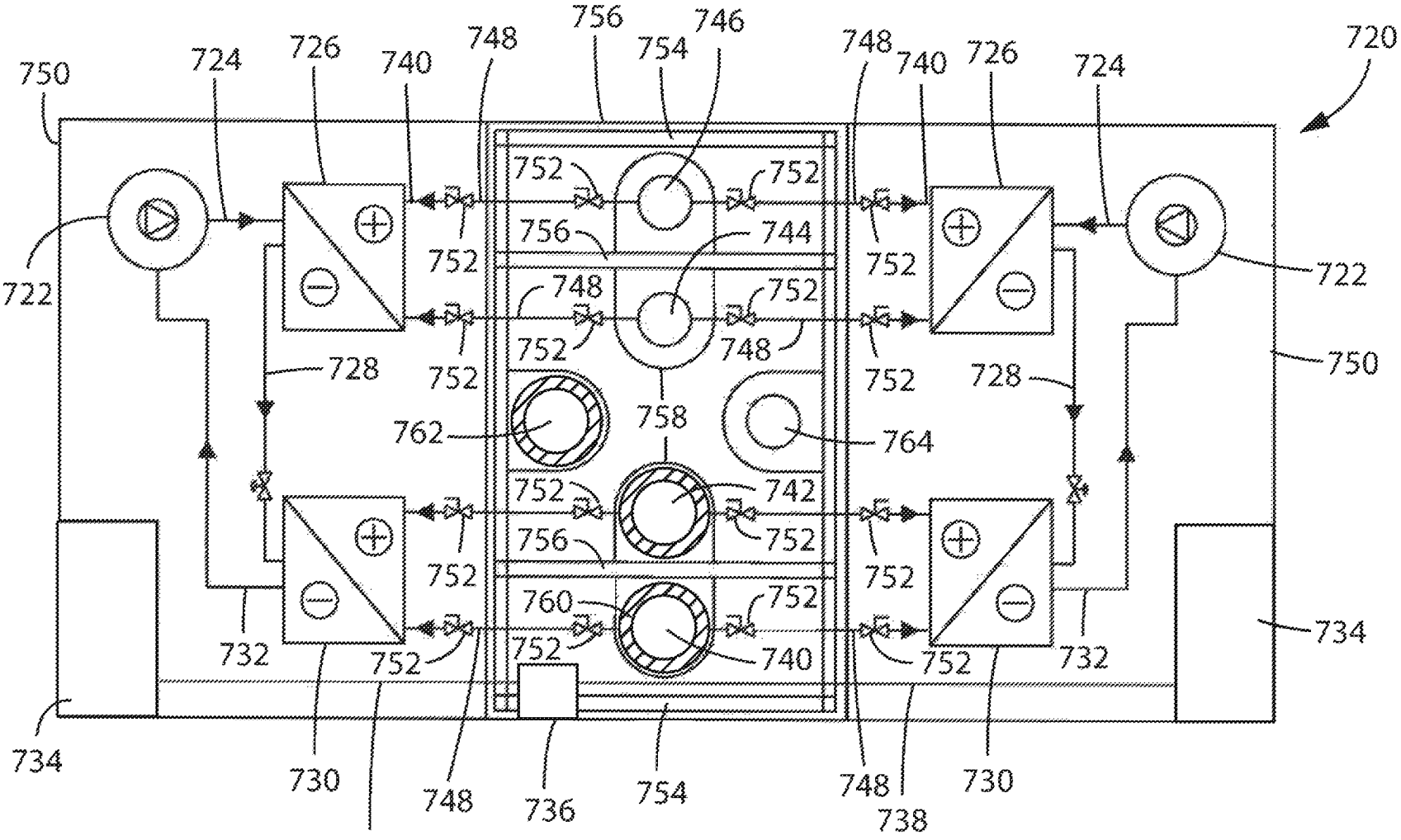
FIG. 19 is a schematic illustration of the internal flow network and valving associated with and suitable for a racked duplex back-to-back configuration such as that illustrated in FIG. 18, according to the present invention.

With reference to FIG. 19, system 720 is best described as the network and connections for a racked modular chiller or heater/chiller with a racked duplex, back-to-back construction. The structures, features and components of system 720 are set forth in the following Table 3:

TABLE 3

| Ref. No. | Description |
|---|---|
| 722 | compressor |
| 724 | hot gas pipe to condenser/heater pipe |
| 726 | brazed plate heat exchanger: condenser |
| 728 | liquid pipe with expansion device |
| 730 | brazed plate heat exchanger: evaporator |
| 732 | suction pipe |
| 734 | starter/control panel |
| 736 | buss bar - alternate for wire whips for main junction box |
| 738 | line voltage from buss bar to starter/control panel |
| 740 | return chilled water in |
| 742 | supply chilled water out |
| 744 | condenser or heating water inlet |
| 746 | condenser or heating water outlet |
| 748 | grooved pipe or flex pipe |
| 750 | rack equipment tray. Sides and cover optional. Acoustical insulation optional |
| 752 | manual isolation valves. Motorized actuators optional. |
| 754 | piping, electric and control wiring chase |
| 756 | structural chase support |
| 758 | pipe/support hanger |
| 760 | pipe insulation on chilled water piping. Note pipe insulation on condenser with heat recovery options. |
| 762 | optional reverse return supply chilled water piping |
| 764 | optional reverse return supply condenser water piping |

FIG. 19 builds on FIG. 4 to put back-to-back refrigeration circuit modules with a single expanded middle pipe chase 754 to form one back-to back array. The middle framework piping/electrical/control chase would be sized for larger, higher capacity, vertical interconnection pipes 740, 742, 744 and 746.

Figure 20:
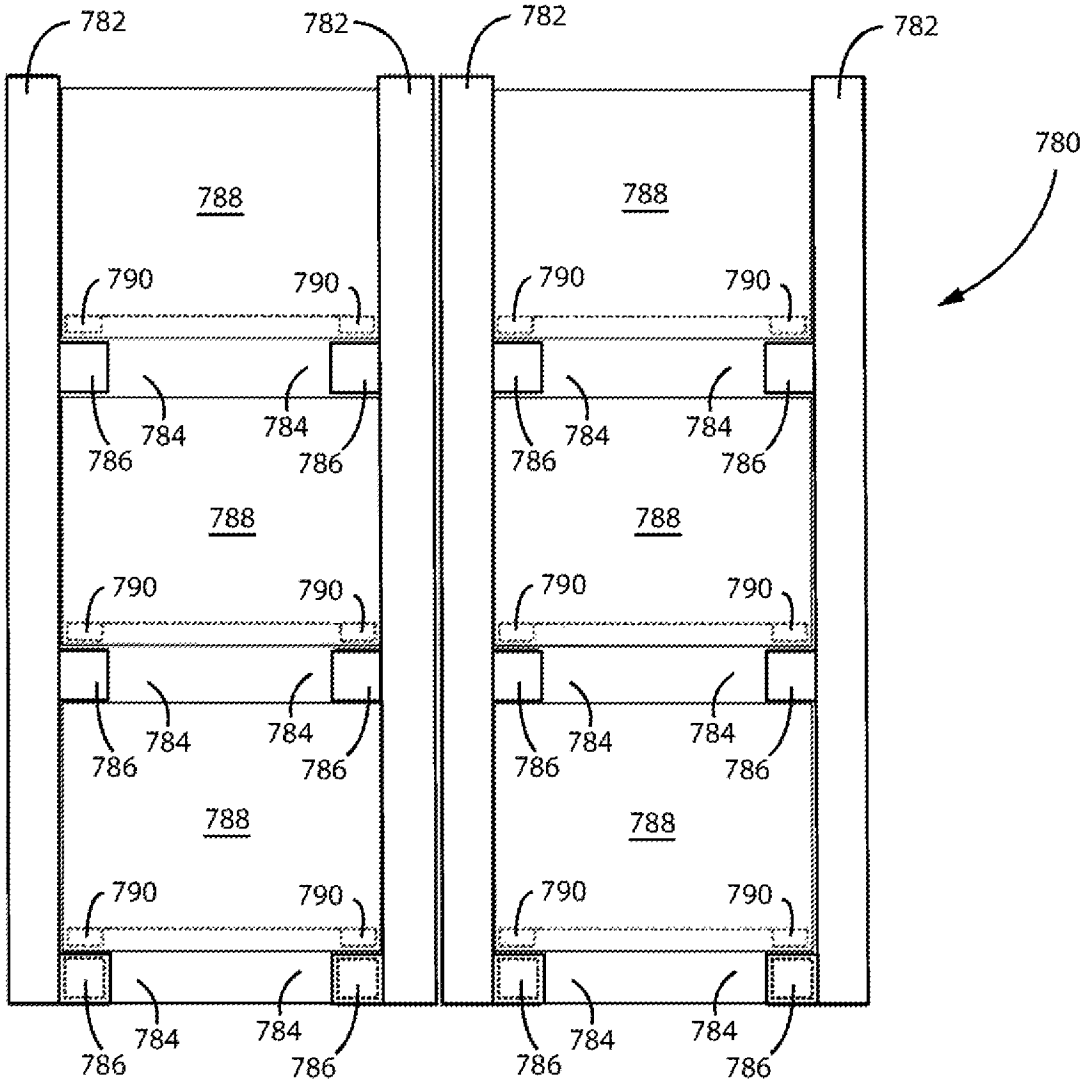
FIG. 20 is a front elevational view, diagrammatic illustration of a racked, side-by-side configuration according to another embodiment of the present invention.

With reference to FIG. 20, system 780 is best described as a multiple modular system including a racked modular chiller, heater/chiller, DX or VRV/VRF with a racked side-by-side construction. The structures, features and components of system 780 are set forth in the following Table 4:

TABLE 4

| Ref. No. | Description |
|---|---|
| 782 | vertical rack supports |
| 784 | horizontal rack supports |
| 786 | horizontal bottom support extension used when pulling out or removing a rack module |
| 788 | chiller or heater/chiller racked modules |
| 790 | slide out rails |

FIG. 20 builds on FIG. 2 and joins two separate, three-module high, vertical module racks 782, 784 and 786 joined side-by-side to become one array 780. The FIG. 20 array concept would be used when maximum capacity is required in a minimum amount of square footage.

Figure 21:
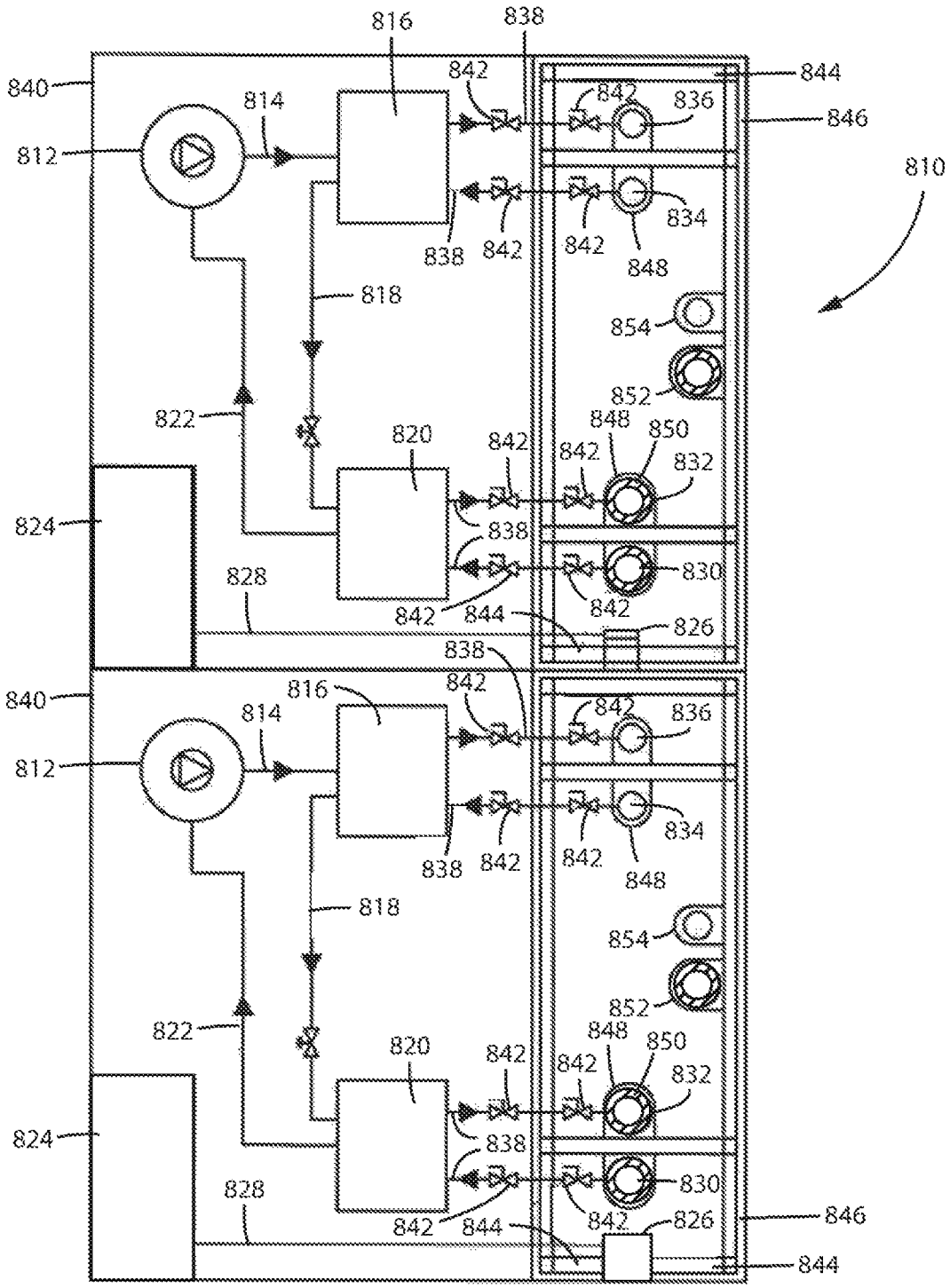
FIG. 21 is a schematic illustration of the internal flow network and valving associated with and suitable for a racked duplex side-by-side configuration such as that illustrated in FIG. 20, according to the present invention.

With reference to FIG. 21, system 810 is best described as a racked modular chiller or heater/chiller with a racked duplex, side-by-side construction. The structures, features and components of system 810 are set forth in the following Table 5:

TABLE 5

| Ref. No. | Description |
|---|---|
| 812 | compressor |
| 814 | hot gas pipe to condenser/heater pipe |
| 816 | brazed plate heat exchanger: condenser |
| 818 | liquid pipe with expansion device |
| 820 | brazed plate heat exchanger: evaporator |
| 822 | suction pipe |
| 824 | Starter/control panel |
| 826 | Buss bar- alternate for wire whips for main junction box |
| 828 | line voltage from buss bar to starter/control panel |
| 830 | return chilled water in |
| 832 | supply chilled water out |
| 834 | condenser or heating water inlet |
| 836 | condenser or heating water outlet |
| 838 | grooved pipe or flex pipe |
| 840 | rack equipment tray. Sides and cover optional. Acoustical insulation optional |
| 842 | manual isolation valves. Motorized actuators optional. |
| 844 | piping, electric and control wiring chase |
| 846 | structural chase support |
| 848 | pipe/support hanger |
| 850 | pipe insulation on chilled water piping. Note pipe insulation on condenser with heat recover options |
| 852 | optional reverse return supply chilled water piping |
| 854 | optional reverse return supply condenser water piping |

FIG. 21 builds on FIG. 4 with the joint duplex modules forming an array corresponding to system 810. Although more capacity can be installed in a smaller footprint, there is only access from the front and one side of the array. Also, the electrical components would be at the "outside" of both racks at control panel 824.

Figure 22:
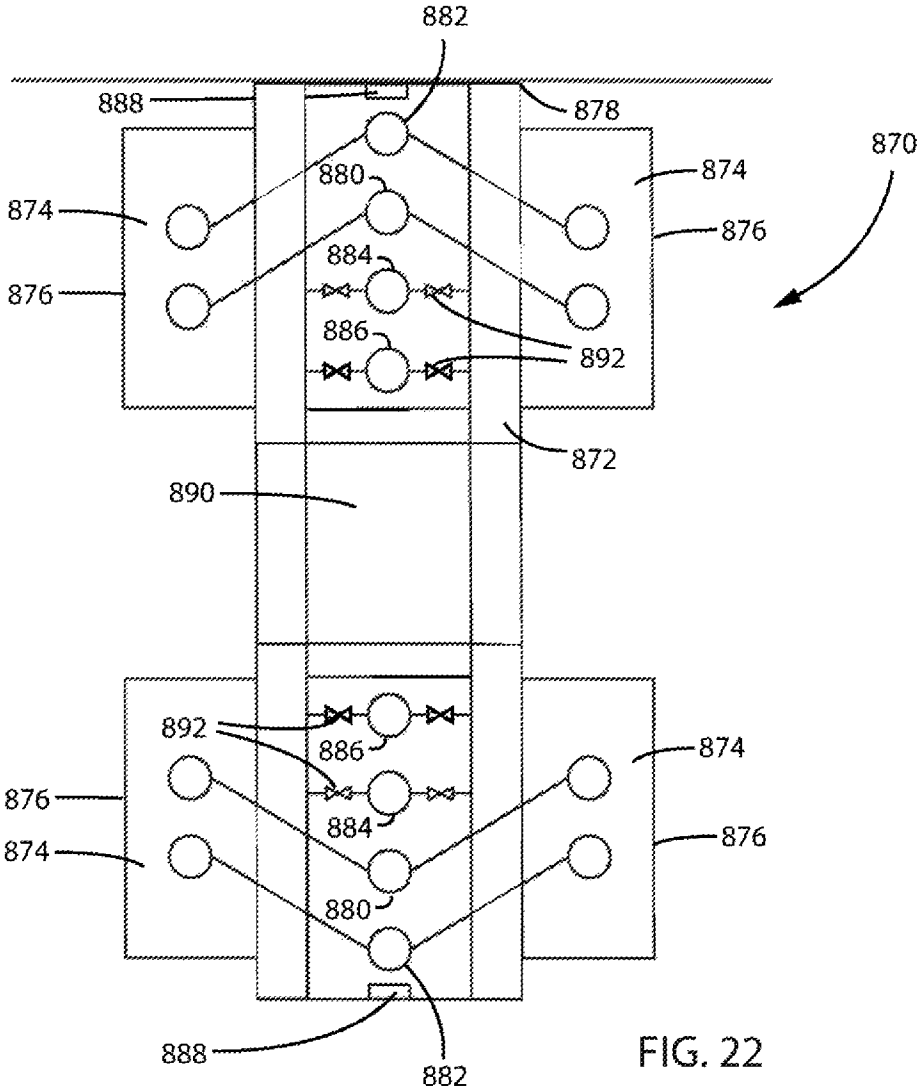
FIG. 22 is a plan view, diagrammatic illustration of racked modular condensing or electrical boilers according to another embodiment of the present invention.

With reference to FIG. 22, system 870 is best described as providing a layout and network for racked modular condensing boilers or electric boilers. The structures, features and components of system 870 are set forth in the following Table 6:

TABLE 6

| Ref. No. | Description |
|---|---|
| 872 | support super structure |
| 874 | high efficiency condensing boiler. Option: electric boilers |
| 876 | vertical racked (2-3 units high) |
| 878 | attached to wall |
| 880 | flue piping |
| 882 | combustion air inlet piping |
| 884 | inlet/return water |
| 886 | discharge/supply water |
| 888 | power and control wiring chase |
| 890 | access/spacer structure |
| 892 | isolation valves |

FIG. 22 builds on FIG. 14 and shows the inner connecting piping from the boilers to the chase including flue, pipe and makeup air piping (see 880, 882, 884 and 886).

Figure 23:
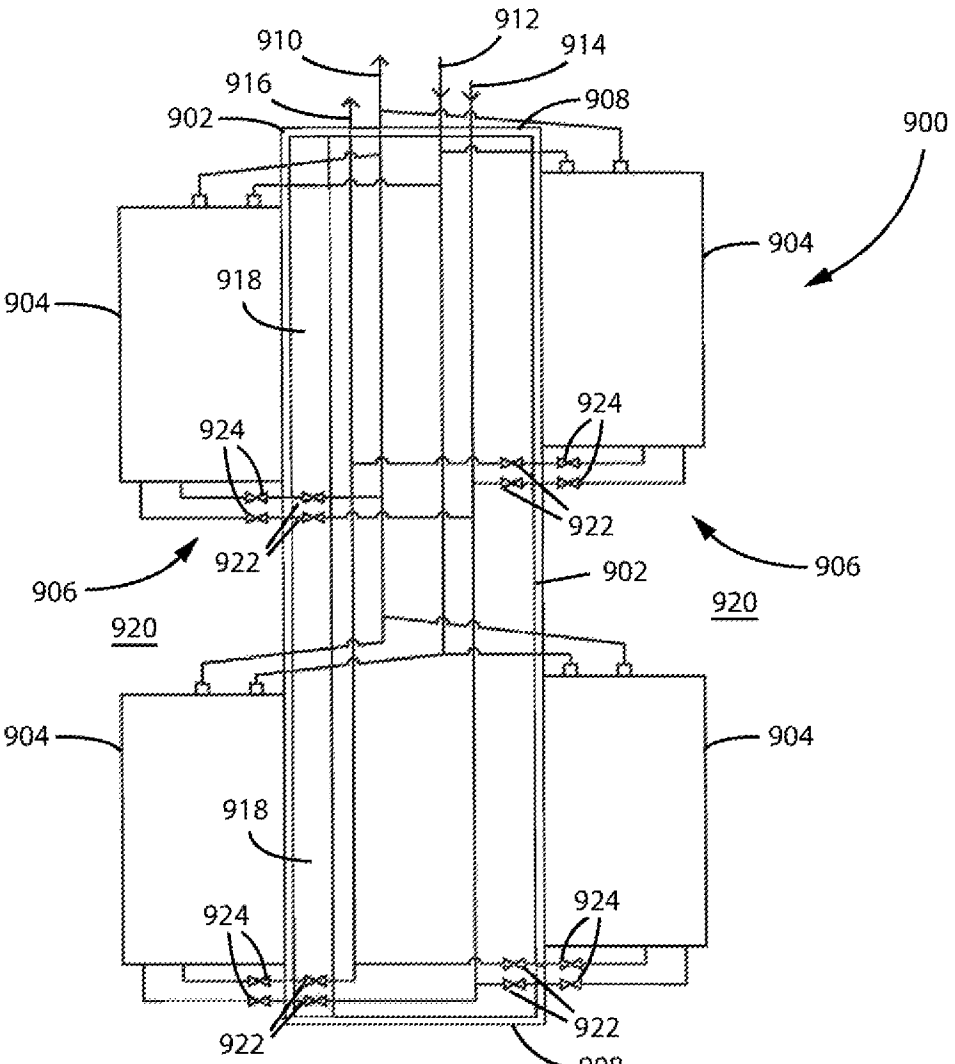
FIG. 23 is a side elevational view, diagrammatic illustration of racked modular wall hung condensing boilers according to another embodiment of the present invention.

With reference to FIG. 23, system 900 is best described as providing a layout a network for racked modular wall hung condensing boilers. The structures, features and components of system 900 are set forth in the following Table 7:

TABLE 7

| Ref No. | Description |
|---|---|
| 902 | support super structure |
| 904 | high efficiency condensing boiler. Option: electric boilers |
| 906 | vertical racked (2-3 units high) |
| 908 | attached to wall |
| 910 | flue piping |
| 912 | combustion air piping |

TABLE 7-continued

| Ref No. | Description |
|---|---|
| 914 | inlet/return water |
| 916 | discharge/supply water |
| 918 | power and control wiring chase |
| 920 | access/spacer structure |
| 922 | piping system isolation valves: optional on/off control valves |
| 924 | boiler piping isolation valves |

FIG. 23 shows an elevation view and the piping of both the bottom hydronic piping 922 and 924 and the top flue 910 and combustion air 912 piping typical for a two-stack, wall-hung condensing boilers 904, 906 on each side of the central chase 918, all held together in a vertical framework 902 that supports the fixed piping and the individual wall-hung condensing boilers.

Figure 24B:
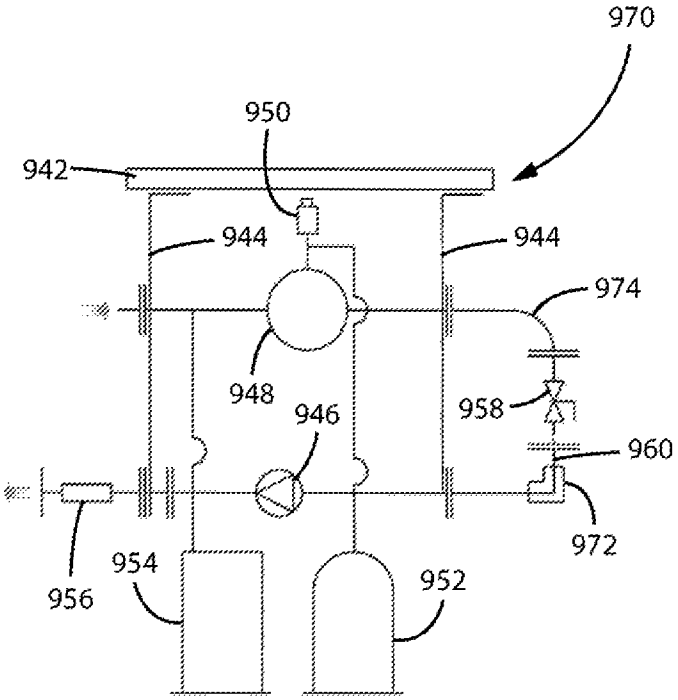
FIG. 24B is an elevational view, diagrammatic illustration of elevated pump(s) trim and hydronic specialties having a stacked configuration according to another embodiment of the present invention.
Figure 24A:
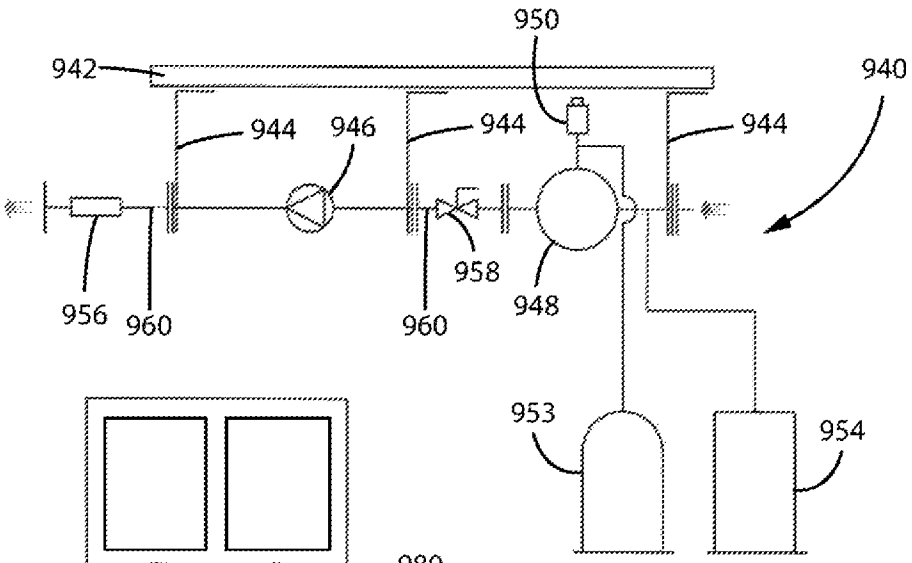
FIG. 24A is an elevational view, diagrammatic illustration of elevated pump(s) trim and hydronic specialties having an in-line configuration according to another embodiment of the present invention.
Figure 24C:
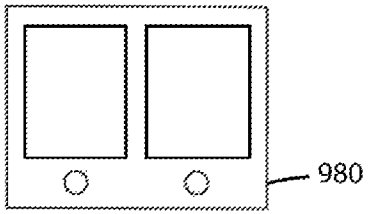
FIG. 24C is a diagrammatic illustration of a remote pump VFD and control panel with pressure gauges.

With reference to FIGS. 24A, 24B and 24C, systems 940, 970 and 980 each pertain to various elevated pumps, trim and hydronic specialties. System 940 illustrates an in-line construction. System 970 illustrates a stacked construction. System 980 as a remote pump VFD and control panel with pressure gauges. The P-1 and P-2 pump pressure gauges of system 980 include stop cocks. The structures, features and components of systems 940 and 970 are set forth in the following Table 8:

TABLE 8

| Ref. No. | Description |
|---|---|
| 942 | roof ceiling mounting supports (2) |
| 944 | steel plate mounting drops |
| 946 | simplex or duplex pumps |
| 948 | air separator |
| 950 | auto air vent |
| 952 | remote expansion tanks(s) |
| 954 | optional auto glycol feed |
| 956 | triple duty valve and/or butterfly valve |
| 958 | butterfly valve |
| 960 | spool piece |
| 972 | suction diffuser |
| 974 | long radius 90 degree elbow |

FIGS. 24A, 24B and 24C show a different way to mount pumps, air separator, expansion tanks, and trim. This can be either as an in-line configuration mounted from a ceiling or, in the case of an "in-floor" system, mounted in the subfloor since one exemplary embodiment is a low profile system shown in FIG. 24A. FIG. 24B takes up more vertical space, but less horizontal space and could be mounted or attached to the ceiling or in a vertical rack like FIG. 15. In both exemplary embodiments expansion tanks and optional glycol feed tanks could be mounted remotely, either from the ceiling or sitting on the floor. The auto glycol tank requires periodic "topping up" so it should be kept fairly accessible. When the pump is mounted to the ceiling or a less accessible space, a remote mounted starter, control or VFD/control panel, also including pump pressure gauges, see FIG. 24C, can be remotely mounted for easy access and visual indication of operation.

Figure 25:
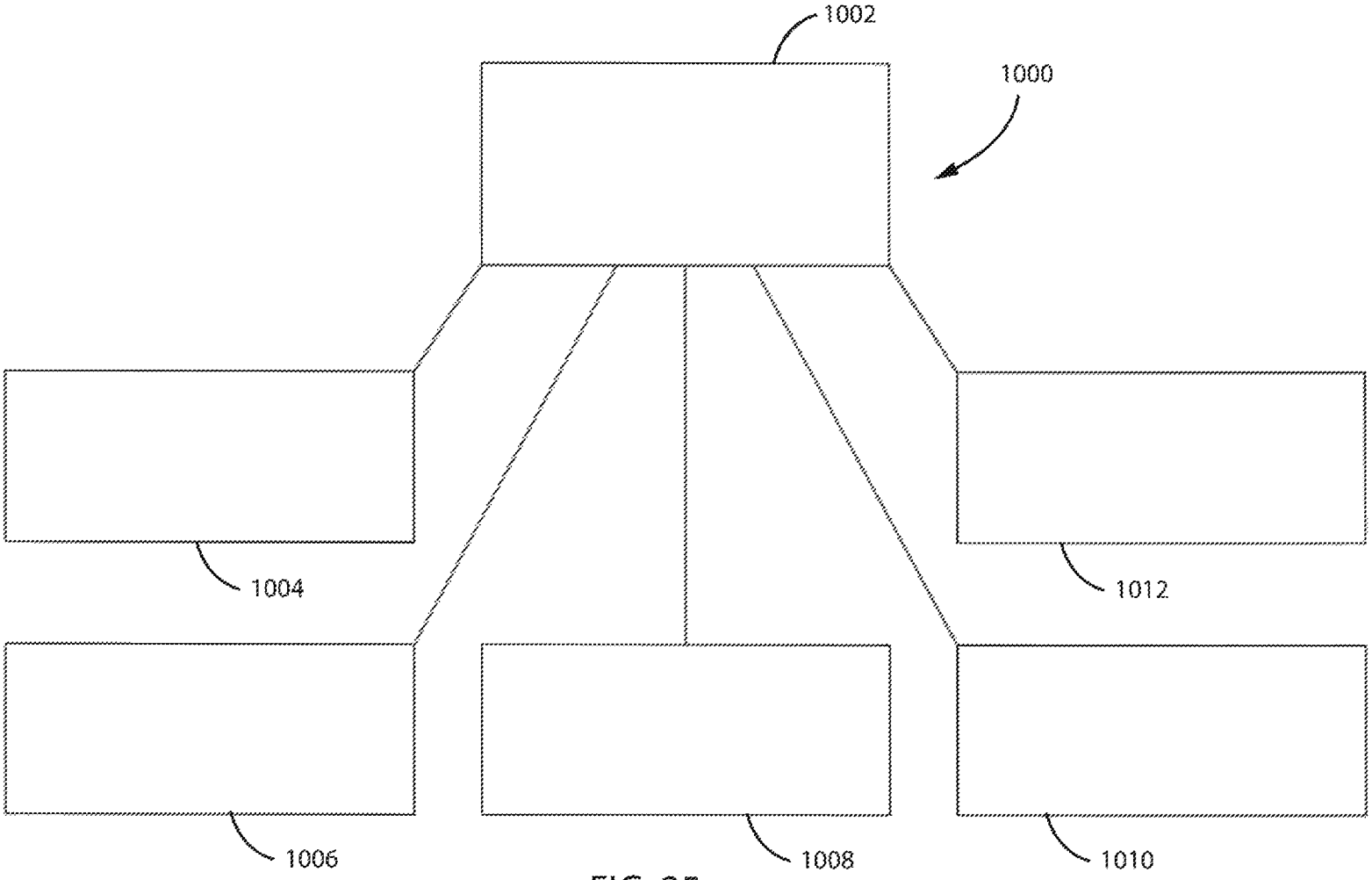
FIG. 25 is a flow diagram of system integrator and interface requirements according to the present invention.

With reference to FIG. 25 a flow diagram 1000 is provided which provides guidance for some of the functions to be performed and the interface and networking requirements likely associated with those functions all as related to the exemplary embodiments disclosed herein. The FIG. 25 flow diagram 1000 is best described as a diagram for a system integrator and interface requirements. The specifics of each block are set forth in the following Table 9.

TABLE 9

| Ref. No. | Description |
|---|---|
| 1002 | system integrator |
| 1004 | equipment selection to heat and cool space or process |
| 1006 | equipment and system design, installation and operation |
| 1008 | ongoing maintenance/service |
| 1010 | end user interface |
| 1012 | engineer and contractor interface for design/construction |

FIG. 25 schematically shows an exemplary embodiment of one possible interface and duties of the systems integrator from project conception through completion and ongoing service, maintenance and end-user interface through the operating life of the system.

Figure 26:
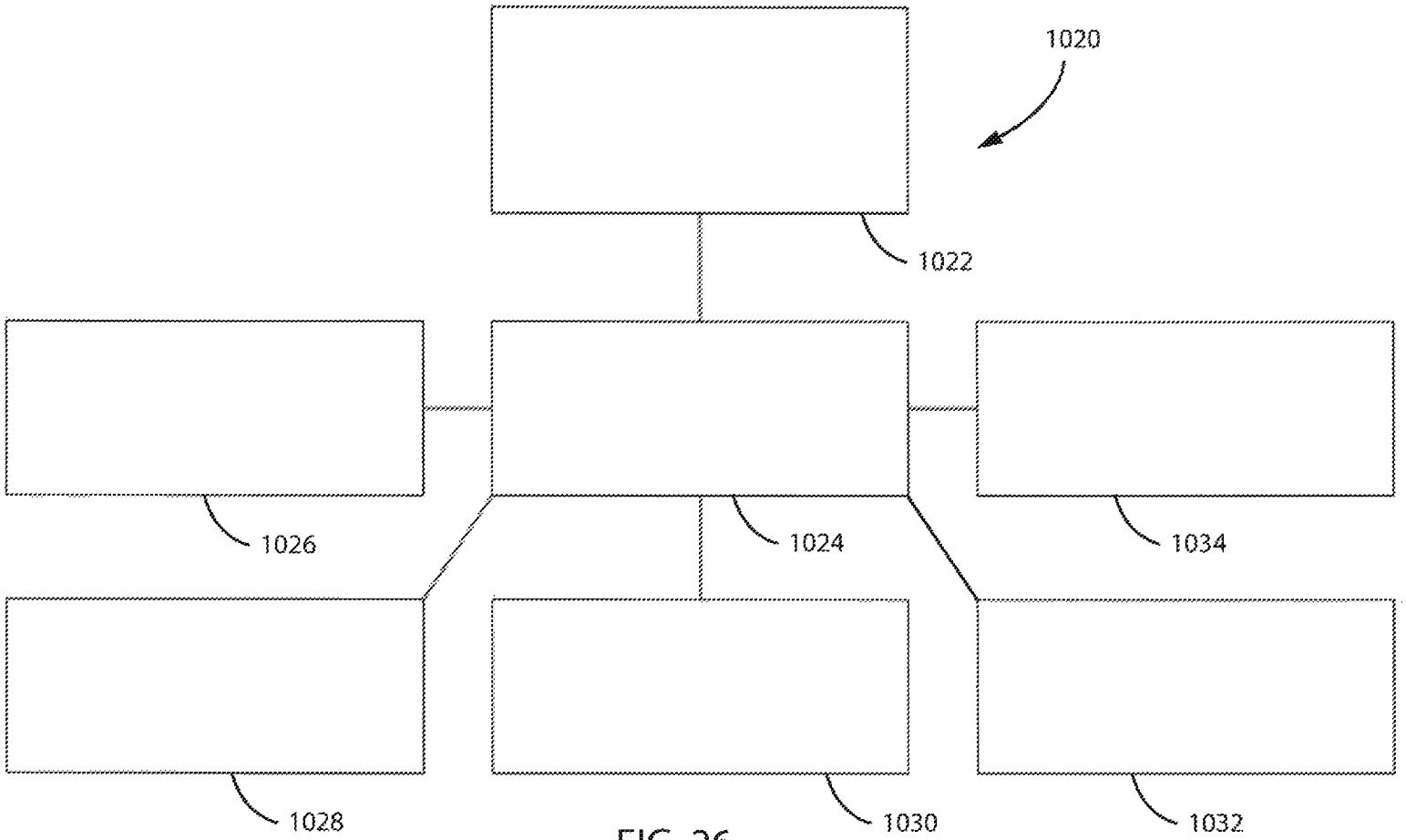
FIG. 26 is a flow diagram of system integrator and control systems, data acquisition and interface according to the present invention.

With reference to FIG. 26 a flow diagram 1020 is provided which provides guidance for some of the functions to be performed and the interface and networking requirements likely associated with those functions all as related to the exemplary embodiments disclosed herein. The FIG. 26 load diagram 1020 is best described as a diagram for a system integrator and Prime Controller interface requirements. The specifics of each block are set forth in the following Table 10:

TABLE 10

| Ref. No. | Description |
|---|---|
| 1022 | system integrator |
| 1024 | prime controller internet based |
| 1026 | weather data interface |
| 1028 | building operational history |
| 1030 | supervisory controller local/site part of equipment |
| 1032 | building space (building automation system - BAS) and/or process interface |
| 1034 | utility interface |

FIG. 26 is a flow diagram of the key functionality of the internet based prime controller including data acquisition and operation of the central plant equipment interfaced to the in-space heating and air conditioning systems; interface for any utilities as required; and acquisition of weather data and operating history to fine tune lowest cost, most efficient operation.

Figure 27:
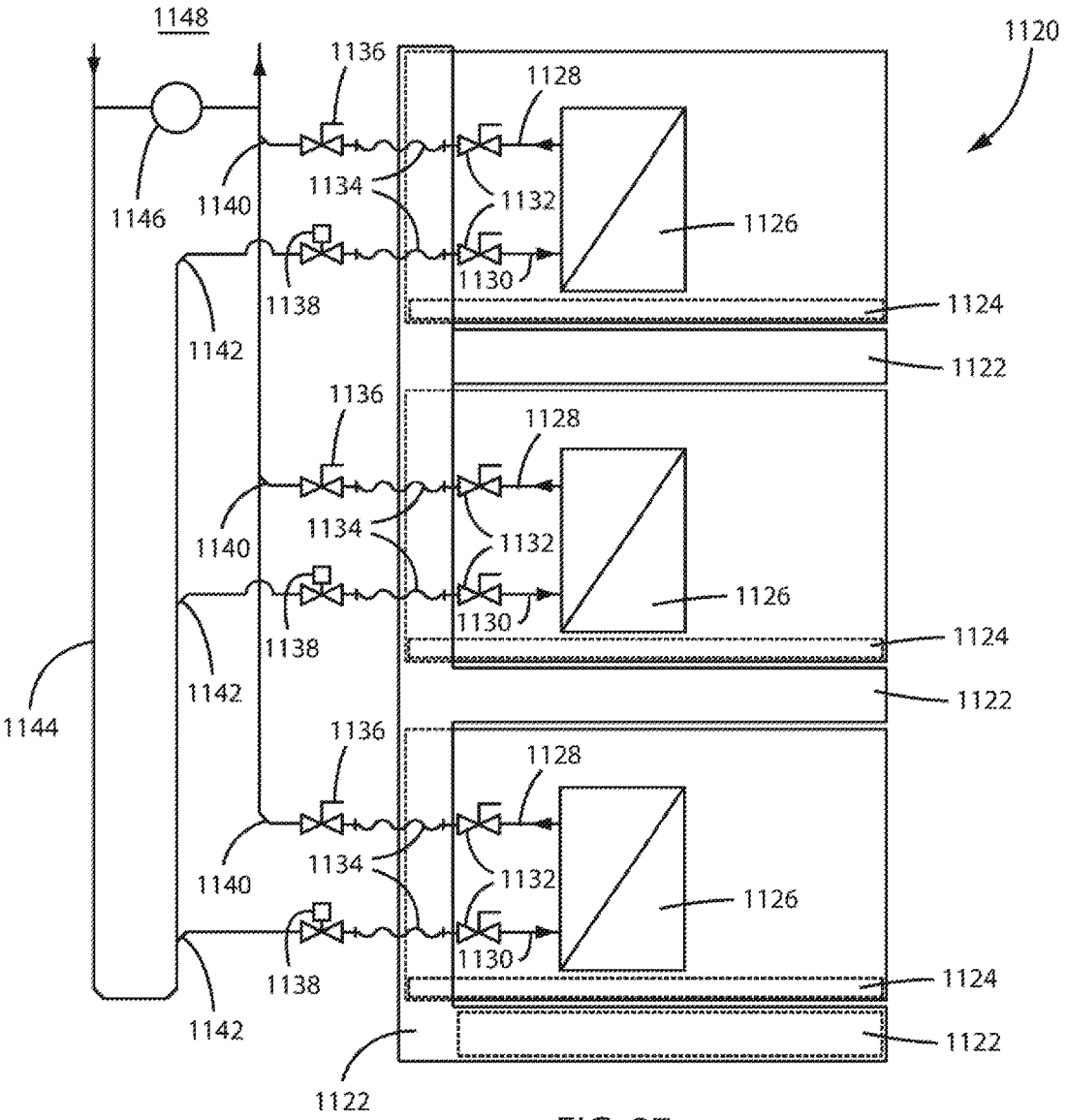
FIG. 27 is a diagrammatic illustration of a multiple module modular system described as chilled water only manifold and refrigeration circuit flow and control, according to the present invention.

Referring now to FIG. 27 a further multiple module modular system 1120 is illustrated. The FIG. 27 system can be described as a "chilled water only manifold and refrigeration circuit flow and control". The illustrated structures, features and components of system 1120 are set forth in the following Table 11:

TABLE 11

| Ref. No. | Description |
|---|---|
| 1122 | refrigeration circuit section framework |
| 1124 | refrigeration circuit support tray component: partial view |
| 1126 | BPHE: evaporator |
| 1128 | chilled water outlet |
| 1130 | chilled water inlet |
| 1132 | isolation valve for refrigeration circuit module |
| 1134 | removable flex connector |
| 1136 | manual isolation valve from manifold piping |
| 1138 | isolation and control valve to adjust flow or provide automatic on/off control to flow to refrigeration circuit(s) |
| 1140 | individual "low pressure" ("Y" + 45 degree elbow vs. "T") outlet piped to chiller water supply manifold |
| 1142 | individual "low pressure" ("Y" + 45 degree elbow vs. "T") inlet piped to chiller water return manifold |
| 1144 | reverse return water manifold piping |

TABLE 11-continued

| Ref. No. | Description |
|---|---|
| 1146 | differential pressure sensor |
| 1148 | piping to/from chilled water pump and cooling requirement |

FIG. 27 shows the front framework 1122 and refrigeration cycle component tray 1124 but only shows the BPHE 1126 and evaporator water piping from the BPHE 1126 through removable front section piping 1128, 1130 and 1134, to the main manifold supply and return pipes 1134, 1140 and 1142 mounted in the back piping framework (not shown). There are isolation valves 1132 that when closed isolate the refrigeration circuit tray when it is not in use or requires service. A second set of isolation valves 1136 and 1138 isolate the fixed piping framework that is interconnected via a removable flex pipe 1134. Isolation valve 1138 can also be closed when the operation is not required if it has an automatic actuator. When this closes it will prevent chilled water return flow into an inactive evaporator and remixing into the supply manifold 1140 and elevating the temperature. When all isolation valves 1132, 1136 and 1138 are closed and the flex pipe 1134 is removed and after electrical and control connections are disconnected between the back framework and the front refrigeration circuit, framework and refrigeration tray 1124 can then be easily removed. An optional I-beam trolley and hoist as described in FIG. 2 and FIG. 3 can be used to remove/reinstall the refrigeration tray without the help of mechanical equipment such as a lift truck. FIG. 27 shows an optional "reverse return" pipe 1144 and a control system differential pressure switch 1146 that provides a control signal for variable speed pumps. The FIG. 27 arrangement can be used either for compression-based cooling-only or compression heating-only, depending on an available source of heat in the winter, i.e. geothermal and with cooling season, external heat rejection.

Figure 28:
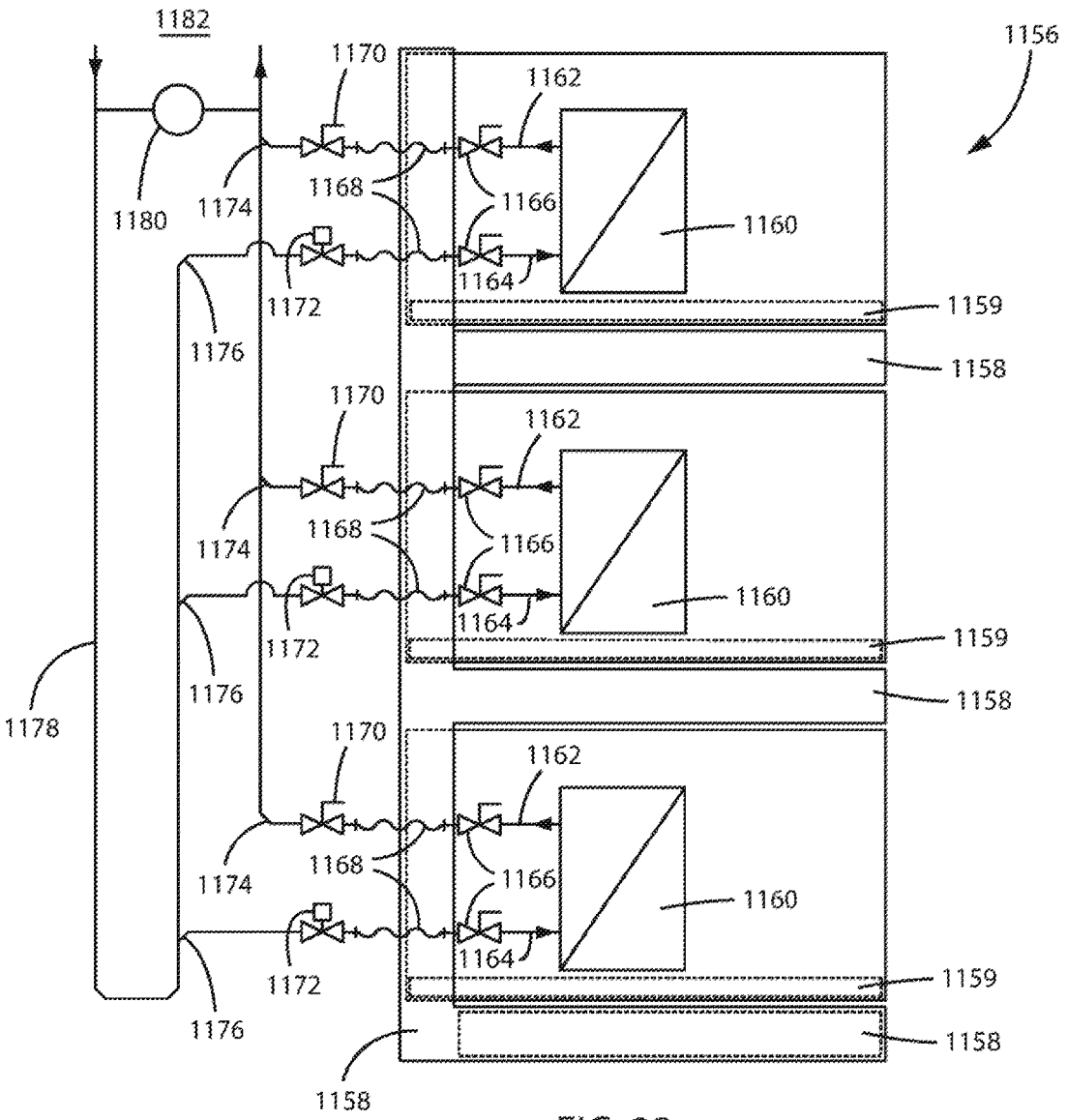
FIG. 28 is a diagrammatic illustration of a multiple module modular system which is described as a condenser water only manifold and refrigeration circuit flow and control, according to the present invention.

Referring now to FIG. 28 a further multiple module modular system 1156 is illustrated. The FIG. 28 system can be described as a "condenser water only manifold and refrigeration circuit flow and control". The illustrated structures, features and components of system 1156 are set forth in the following Table 12:

TABLE 12

| Ref. No. | Description |
|---|---|
| 1158 | refrigeration circuit section framework |
| 1159 | refrigeration circuit support tray component: partial view |
| 1160 | BPHE: condenser |
| 1162 | condenser water outlet |
| 1164 | condenser water inlet |
| 1166 | isolation valve for refrigeration circuit |
| 1168 | removable flex connector |
| 1170 | manual isolation valve from manifold piping |
| 1172 | isolation and control valve to adjust flow or provide automatic on/off control of flow to refrigeration circuit(s) |
| 1174 | individual "low pressure" ("Y" + 45 degree elbow vs. "T") outlet piped to chiller water supply manifold |
| 1176 | individual "low pressure" ("Y" + 45 degree elbow vs. "T") inlet piped to chiller water return manifold |
| 1178 | reverse return water manifold piping |
| 1180 | differential pressure sensor |
| 1182 | piping to/from heat rejection equipment heating load pump and remote air, wet/dry or evaporative cooler or cooling tower |

FIG. 28 describes the condenser water piping from the BPHE: Condenser 1160 through to the main manifold supply 1174 and return 1176 pipes mounted in the back piping framework (not shown). There is a refrigeration cycle tray 1159 isolation valve 1166 from the hydronic supply 1162 and return 1164 pipe out of the BPHE 1160. The isolation valves can be closed when the tray is not in use or requires service. There is a second isolation valve just into the piping framework 1170 and 1172 that is interconnected via removable flex pipe 1168. This second isolation valve 1172 in the framework can also be closed when the operation is not required if it has an automatic actuator. When this closes it will prevent condenser water return flow into an inactive condenser and remixing in the supply manifold 1174 and elevating the condenser water temperature. Optionally it can be a manual valve that when both isolation valves 1170 and 1172 and the flex pipe on both the supply and return can be removed and after electrical and control connections are disconnected between the back framework and the front refrigeration circuit framework, the tray can then be easily removed. This arrangement can be used either for compression-based cooling-only or compression heating-only, depending on available source of heat in the winter, i.e. geothermal and with cooling season, external heat rejection.

Figure 29:
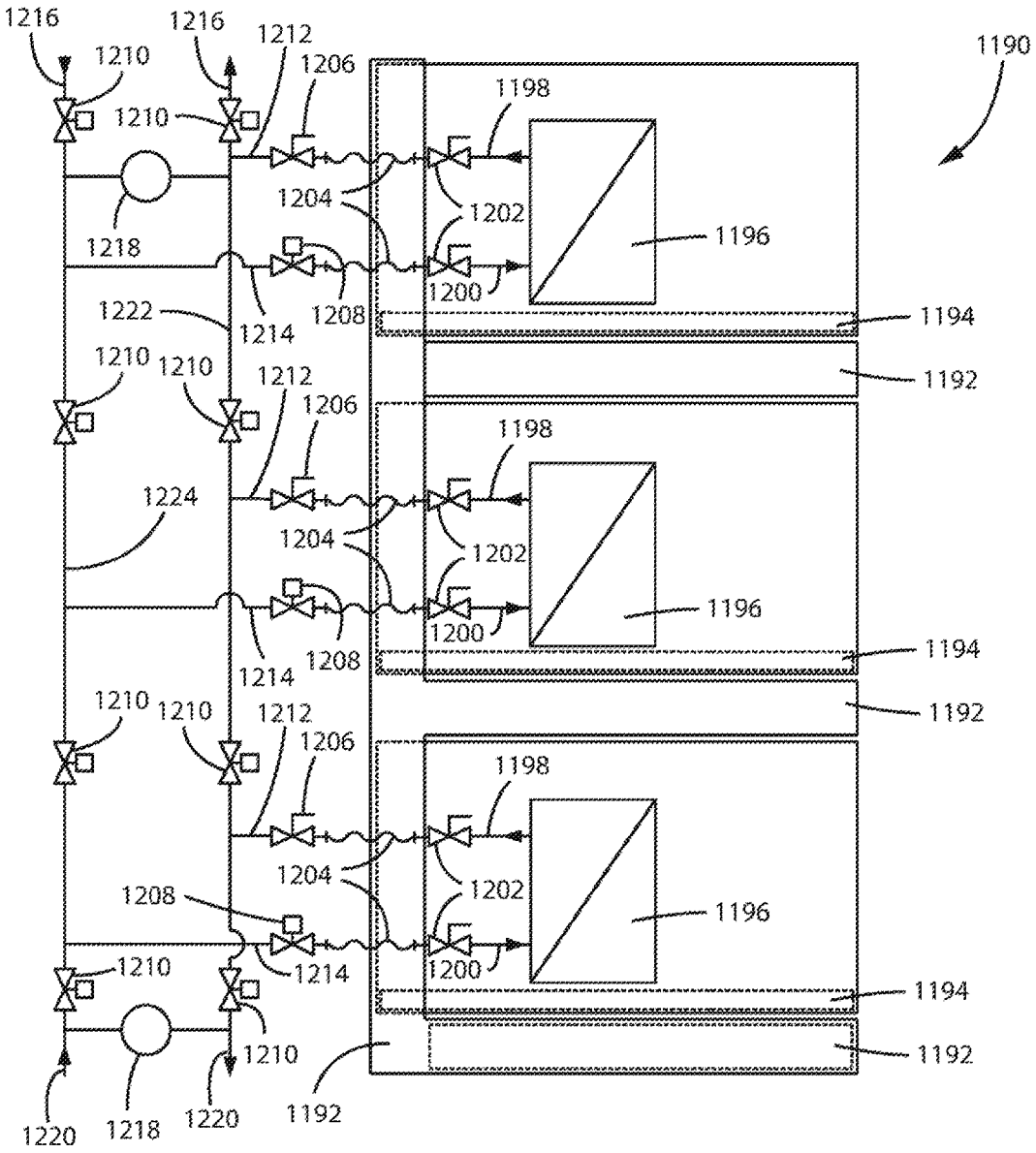
FIG. 29 is a diagrammatic illustration of a multiple module modular system described as heater/chiller to supply chilled water only, hot water only or simultaneous hot and cold water chilled water production or heat absorption, according to the present invention.

Referring now to FIG. 29 a further multiple module modular system 1190 is illustrated. The FIG. 29 system can be described as a "heater/chiller to supply chilled water only, hot water only or simultaneous hot and cold water chilled water production or heat absorption". The illustrated structures, features and components of system 1190 are set forth in the following Table 13:

TABLE 13

| Ref. No. | Description |
|---|---|
| 1192 | refrigeration circuit section framework |
| 1194 | refrigeration circuit support tray component: partial view |
| 1196 | BPHE: evaporator |
| 1198 | chilled water outlet |
| 1200 | chilled water inlet |
| 1202 | isolation valve for refrigeration circuit |
| 1204 | removable flex connector |
| 1206 | manual isolation valve from manifold piping |
| 1208 | isolation and control valve to adjust flow or provide automatic on/off control of flow to refrigeration circuit(s) |
| 1210 | automated isolation control valve to control flow to/from either the cooling lead or to/from the heat absorption source for heating only or simultaneous heating and cooling |
| 1212 | outlet piped to chiller water supply manifold tee |
| 1214 | inlet piped to chiller water return manifold |
| 1216 | flow to/from chilled water pump and load |
| 1218 | differential pressure sensor |
| 1220 | flow to/from heat absorption or geothermal source |
| 1222 | supply water manifold |
| 1224 | return water manifold |

FIG. 29 builds on FIG. 27 and adds additional motorized control valves 1210 in the supply 1222 and return 1224 manifold piping to open or close to control flow to the cooling load/heat absorption source 1216 or for simultaneous heating and cooling mode. The control logic for simultaneous heating and cooling identifies the smaller of the cooling or heating requirement and operates to satisfy the smaller of the heating and cooling load. The larger of the heating and cooling load would be met with additional trays operating in cooling-only or heating-only mode. The prime controller (not shown) has the control logic to determine which trays are active and, depending on which motorized valves are open or closed, would direct flow for chilled water, heat absorption water or geothermal loop water. As shown, the manifold piping 1222 and 1224 is direct supply/return because of multiple valve configurations reverse return piping is not a viable option. With the addition of a differential pressure sensor across the BPHE 1196 inlet/outlet and an adjustable position actuator valve 1208 and with additional control logic for the operation of 1208 and the pumping system (not shown), valve could modulate to maintain the design pressure drop across BPHE 1196.

Figure 30:
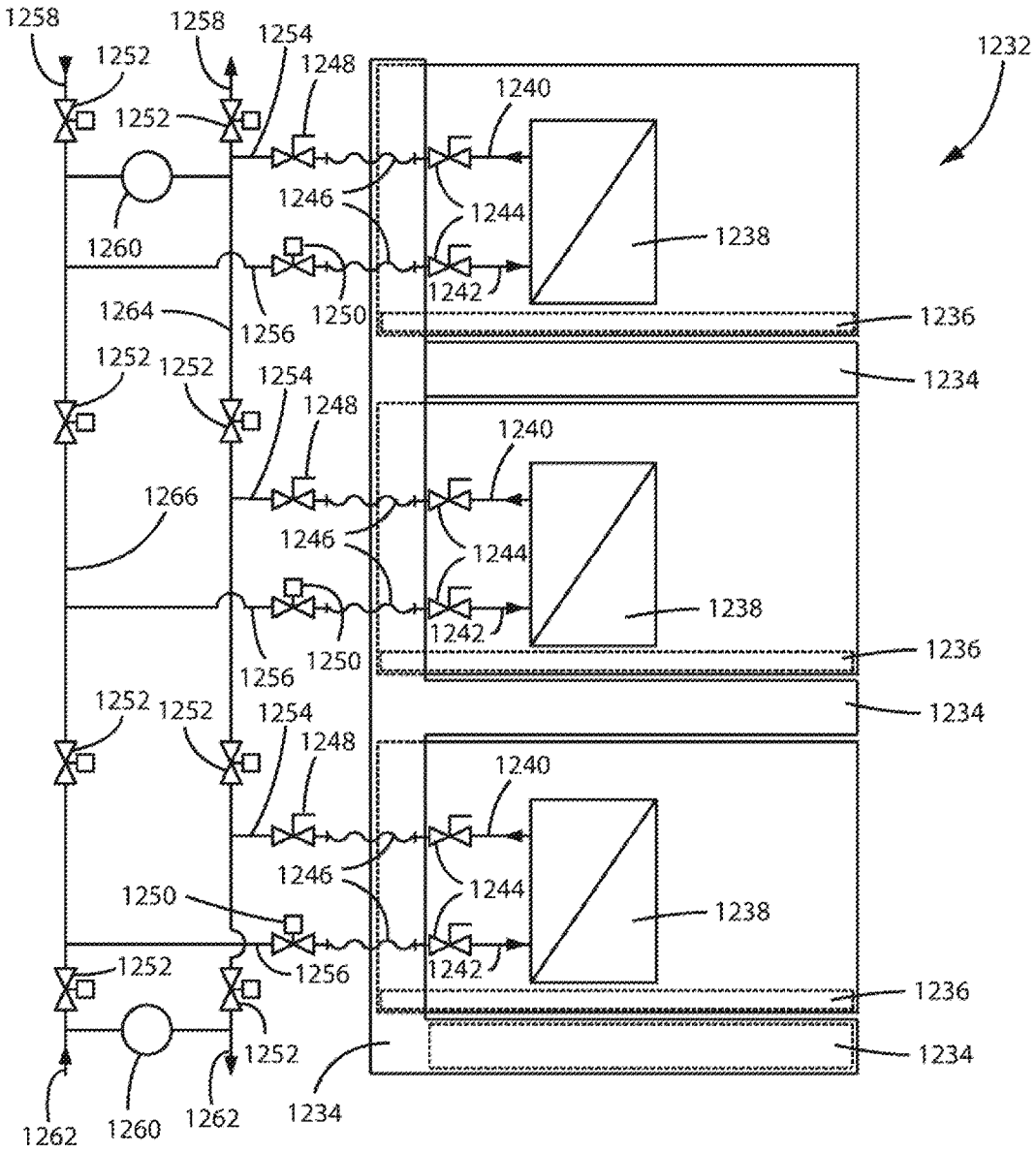
FIG. 30 is a diagrammatic illustration of a multiple module modular system described as heater/chiller to supply chilled water only, hot water only or simultaneous hot and cold water condenser water or heat rejection, according to the present invention.

Referring now to FIG. 30 a further multiple module modular system 1232 is illustrated. The FIG. 30 system can be described as a "heater/chiller to supply chilled water only, hot water only or simultaneous hot and cold water condenser water or heat rejection". The illustrated structures, features and components of system 1232 are set forth in the following Table 14:

TABLE 14

| Ref. No. | Description |
|---|---|
| 1234 | refrigeration circuit section framework |
| 1236 | refrigeration circuit support tray component: partial view |
| 1238 | BPHE: condenser |
| 1240 | condenser water outlet |
| 1242 | condenser water inlet |
| 1244 | isolation valve for refrigeration circuit |
| 1246 | removable flex connector |
| 1248 | manual isolation valve from manifold piping |
| 1250 | isolation and control valve to adjust flow or provide automatic on/off control of flow to refrigeration circuit(s) |
| 1252 | automated isolation control valve to control flow to/from the heating load or the heat rejection equipment for heating only or cooling only or simultaneous heating and cooling |
| 1254 | outlet piped to condenser water supply manifold tee |
| 1256 | inlet piped to condenser water return manifold |
| 1258 | flow to/from heating water pump and load |
| 1260 | differential pressure sensor |
| 1262 | flow to/from heat rejection pump and equipment and/or geothermal loop |
| 1264 | supply water manifold |
| 1266 | return water manifold |

FIG. 30 builds on FIG. 28 and adds additional motorized control valves 1252 in the supply 1264 and return 1266 manifold piping to supply heating water or open or close to control flow to the condenser heat rejection equipment or for the simultaneous heating and cooling. The control logic for simultaneous heating and cooling identifies the smaller of the cooling or heating requirement and operates to satisfy the smaller of the heating and cooling load. The larger of the heating and cooling load would be met with additional trays operating in cooling-only or heating-only mode. The prime controller (not shown) has the control logic to determine which trays are active and depending on which motorized valves are open or closed, would direct condenser water, heating water, condenser heat rejection, condenser heat recovery or with additional piping/valving and control logic to integrate geothermal heat rejection/heat absorption 1262 for 100 percent of load requirements or if the geothermal loop system has less than 100 percent capacity, would control the use of additional boiler(s) or heat rejection to satisfy the load requirements. As shown, the manifold piping 1264 and 1266 is direct supply/return because of multiple valve configurations reverse return piping is not a viable option. With the addition of a differential pressure sensor across the BPHE 1238 inlet/outlet 1240 and 1242 and an adjustable position actuator valve 1250 with additional control logic for 1250 and the pumping system (not shown), valve 1250 could modulate to maintain design pressure drop across BPHE 1238.

Figure 31:
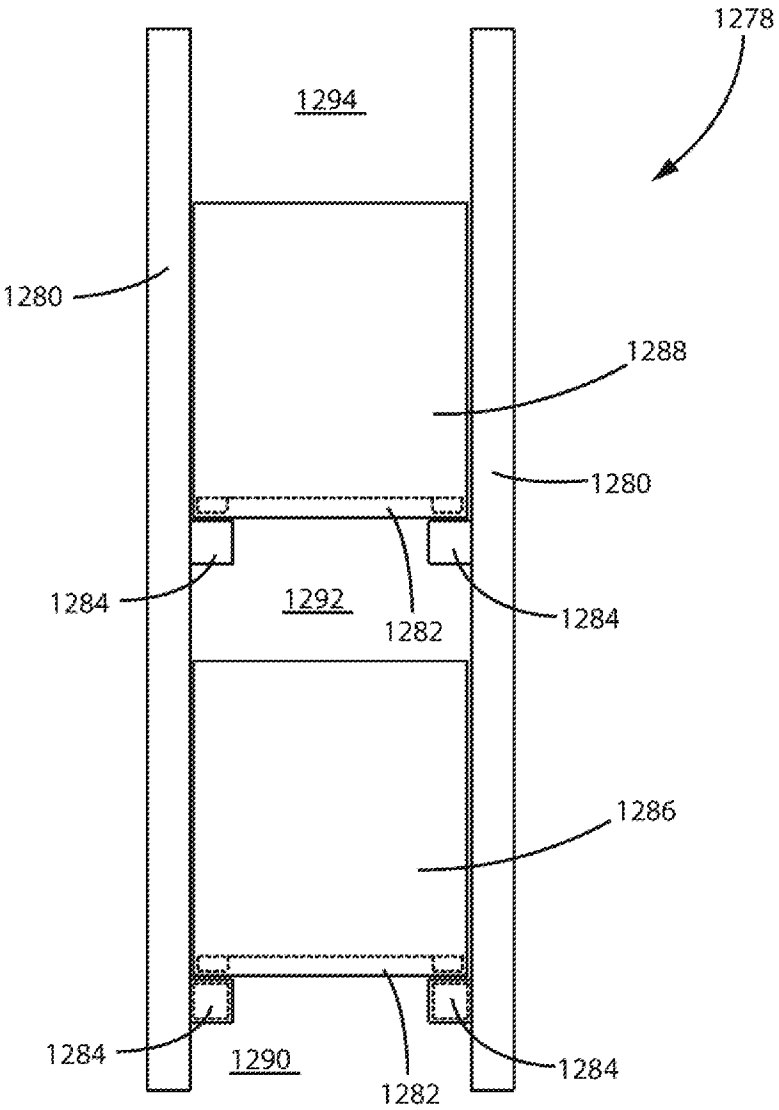
FIG. 31 is a front elevational view of a racked modular vertically mounted, wall hung boiler system according to the present invention.

Referring now to FIG. 31 a further multiple module modular system 1278 is illustrated. The FIG. 31 system can best be described as a "racked modular vertically mounted, wall hung boiler". The illustrated structures, features and components of system 1278 are set forth in the following Table 15:

TABLE 15

| Ref. No. | Description |
|---|---|
| 1280 | vertical rack supports |
| 1282 | horizontal rack tray/boiler support |
| 1284 | horizontal bottom support and extension used when pulling out or removing a rack module |
| 1286 | wall hung modular boiler #1 |
| 1288 | wall hung modular boiler #2 |
| 1290 | area below boiler #1 for water inlet/outlet and condensate piping connection |
| 1292 | area between boiler #1 and #2 for boiler #1 to flue and makeup air connection and below boiler #2 for water inlet/outlet and condensate piping connection |
| 1294 | area for boiler #2 top flue and makeup air connection |

FIG. 31 takes the previous concepts of a mounting framework for multiple refrigeration circuit modules and pumping systems and adapts it to hold multiple "wall hung," high efficiency condensing boilers and mounts them in a multi-unit vertical rack only limited by ceiling height. Although similar to earlier exemplary embodiments, the vertical rack 1280, 1282, and 1284 in this case, holds two wall hung boilers leaving open area space below and above the boilers for connection of inlet and outlet water piping, condensate piping, electrical, power and control wiring and exhaust flue and combustion makeup air piping.

Figure 32:
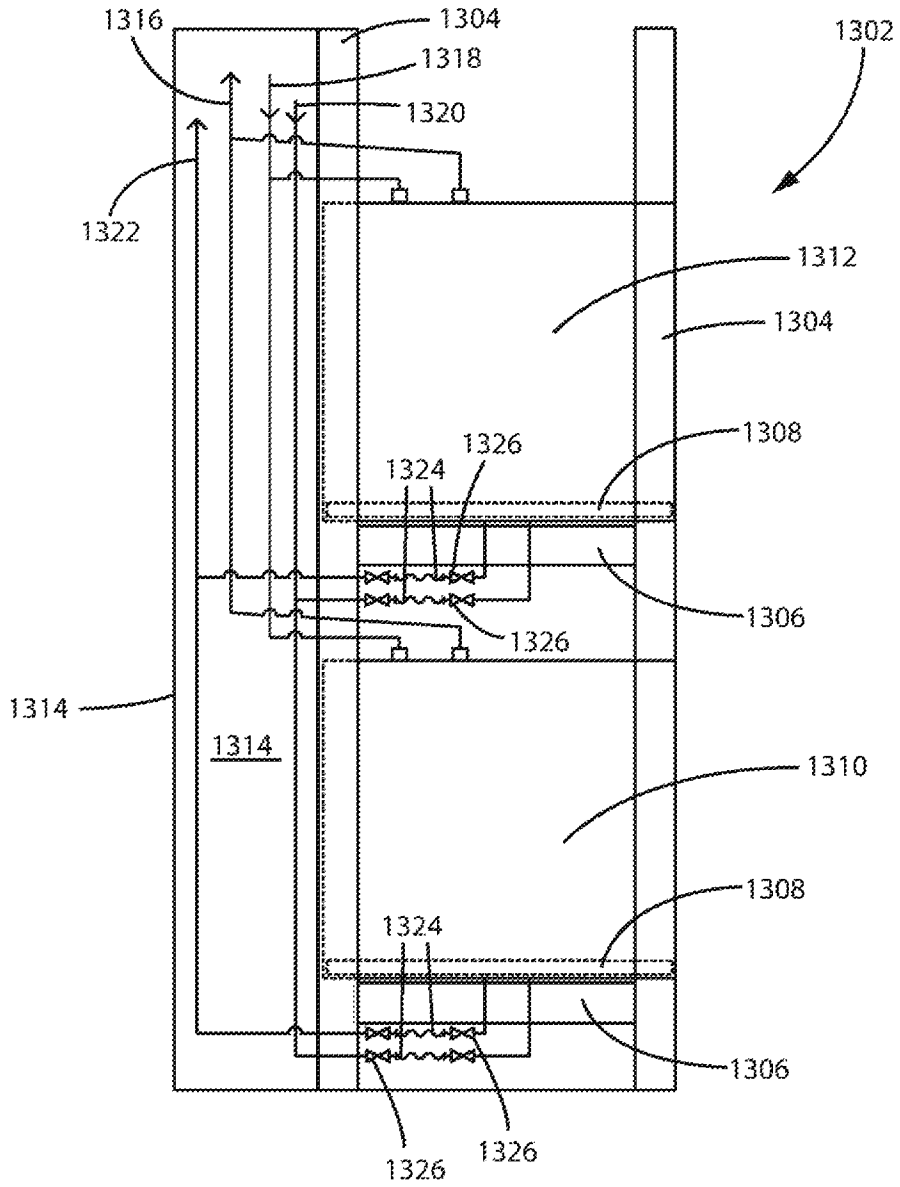
FIG. 32 is a side elevational view of a racked modular duplex, wall hung condensing boilers, according to the present invention.

Referring now to FIG. 32 a further multiple module modular system 1302 is illustrated. The FIG. 32 system can best be described as a "racked modular duplex, wall hung condensing boilers". The illustrated structures, features and components of system 1302 are set forth in the following Table 16:

TABLE 16

| Ref No. | Description |
|---|---|
| 1304 | vertical rack supports |
| 1306 | horizontal rack supports |
| 1308 | slide out rails |
| 1310 | boiler #1 |
| 1312 | boiler #2 |
| 1314 | piping/electrical/control chase |
| 1316 | flue pipe |
| 1318 | combustion air pipe |
| 1320 | return water pipe |
| 1322 | supply water pipe |
| 1324 | removable flex connector |
| 1326 | isolation valves |

FIG. 32 is an elevation side view and has added the back chase framework 1314 including inlet/outlet hot water, condensate piping, inlet/exhaust flue and combustions air 1316, 1318, 1320 and 1322, power and control wiring to the front framework 1304, 1306 and 1308. FIG. 32 shows a single rack, but could also be a duplex back-to-back boiler rack with central piping chase of earlier exemplary embodiments showing back-to-back refrigeration cycle racks. FIG. 32 builds on FIG. 23 showing an elevation view with more details of the vertical and horizontal rack 1304 and 1306 and includes the top exhaust flue pipe 1316 and combustion air makeup 1318 and with hydronic piping 1320 and 1322 including isolation valves 1326 and a removable flex connector 1324 so the boiler can be easily removed from the rack system for service or replacement.

Figure 33:
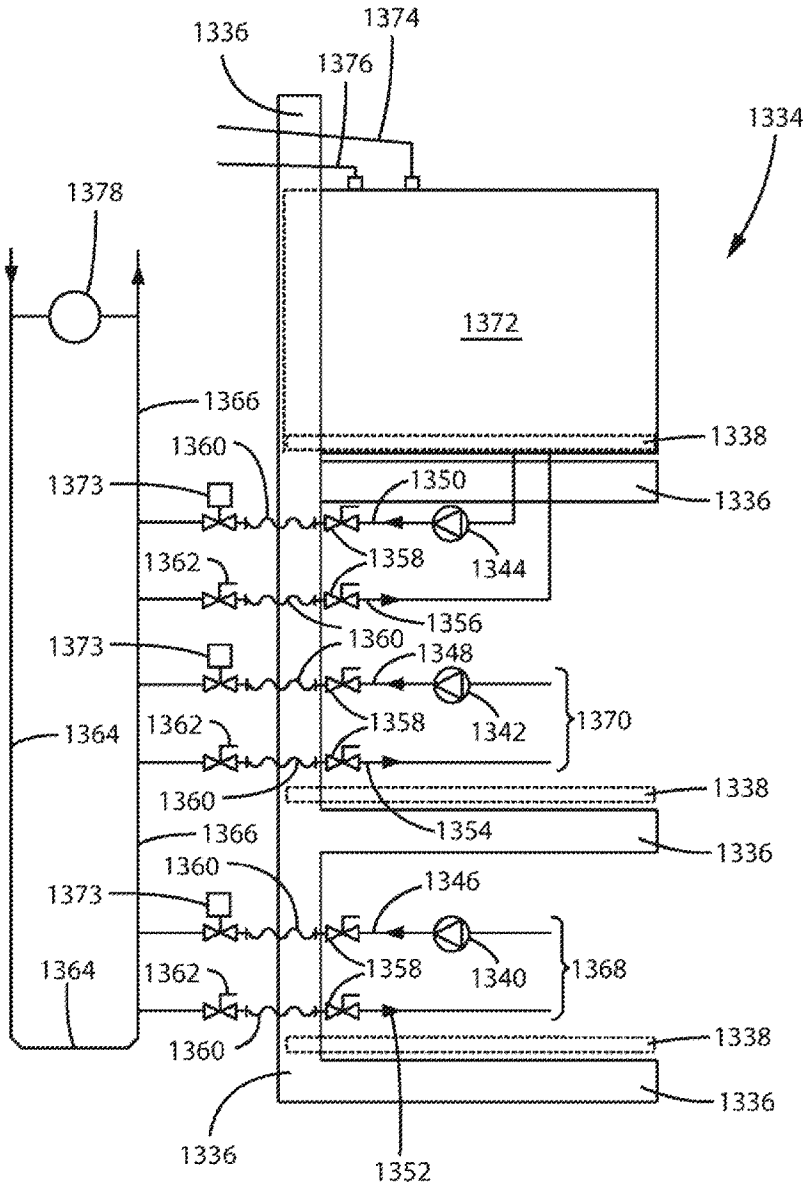
FIG. 33 is a diagrammatic illustration of a multiple module modular system described as heating water manifold, according to the present invention.

Referring now to FIG. 33 a further multiple module modular system 1334 is illustrated. The FIG. 33 system can best be described as a "heating water manifold". The illustrated structures, features and components of system 1334 are set forth in the following Table 17:

TABLE 17

| Ref. No. | Description |
|---|---|
| 1336 | support framework |
| 1338 | module support tray |
| 1340 | pump to/from remote heat recovery source |
| 1342 | pump to/from remote solar/thermal/renewable energy source |
| 1344 | primary boiler pump |
| 1346 | first stage heating water supply pipe |
| 1348 | second stage heating water supply pipe |
| 1350 | third stage heating water supply pipe |
| 1352 | first stage heating water return pipe |
| 1354 | second stage heating water return pipe |
| 1356 | third stage heating water return pipe |
| 1358 | isolation valve for equipment module |
| 1360 | removable flex connector |
| 1362 | manual isolation valve for fixed pipe chase |
| 1364 | return pipe from heating load |
| 1366 | heating water supply manifold |
| 1368 | supply/return piping to heat recovery heater/chiller |
| 1370 | supply/return piping to solar thermal |
| 1372 | condensing boiler - one shown; could be multiple |
| 1373 | automatic control/isolation valve |
| 1374 | exhaust flue |
| 1376 | combustion air |
| 1378 | pressure differential |

FIG. 33 lays out how the heating racking system would be used to tie together various sources of heat, including condenser heat recovery, solar thermal heating, or other renewable energy sources of heat and includes one or more racked boilers. FIG. 33 builds on FIGS. 23 and 32 to show the horizontal and vertical racking system 1336 with piping and integration of heat sources from the compression heater/chiller 1368 or auxiliary solar thermal panel system 1370 with a final heating from a condensing boiler 1372.

Figure 34A:
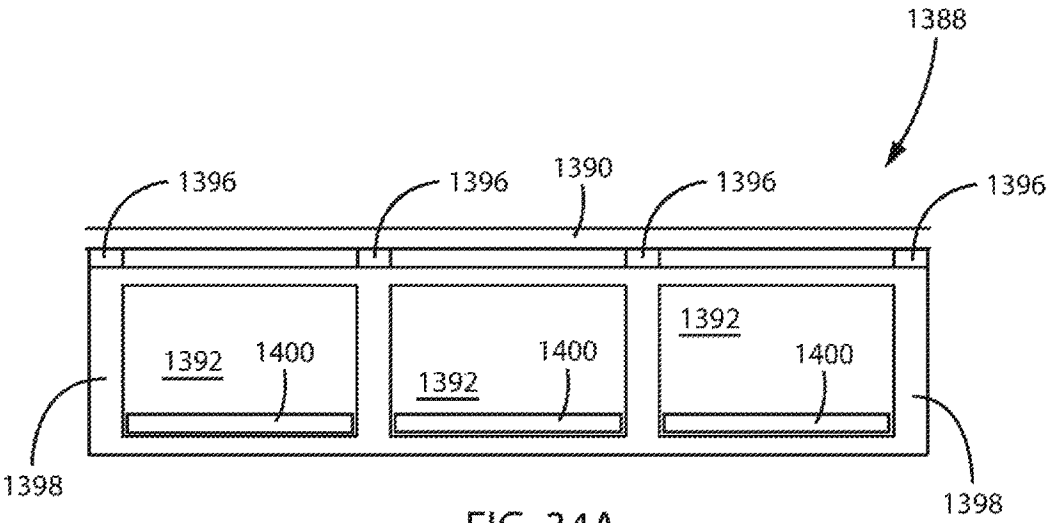
FIG. 34A is a side elevational view of an indoor horizontal rack system according to the present invention.
Figure 34B:
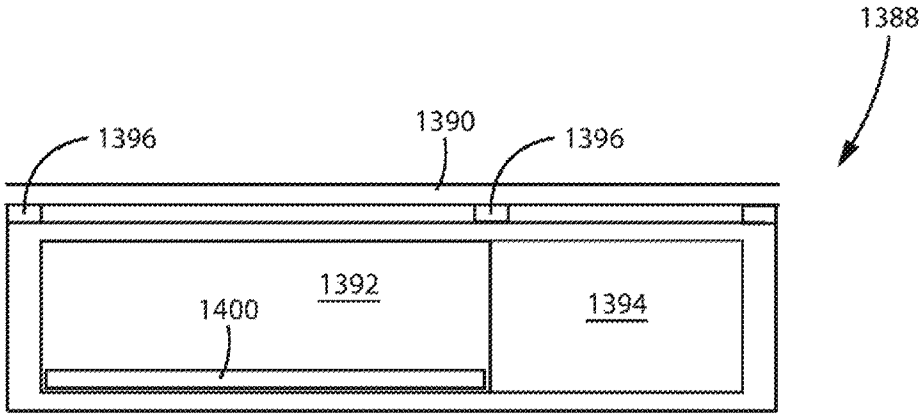
FIG. 34B is an end elevational view of the FIG. 34A indoor horizontal rack system.

Referring now to FIGS. 34A and 34B, a further multiple module modular system 1388 is illustrated. The FIGS. 34A and 34B system can best be described as an "indoor horizontal rack system". The illustrated structures, features and components of system 1388 are set forth in the following Table 18:

TABLE 18

| Ref. No. | Description |
|---|---|
| 1390 | ceiling |
| 1392 | racked compressor cooling cycle or heater/chiller module(s) |
| 1394 | chase for horizontal piping/electrical/control |
| 1396 | hardware to hang unit |
| 1398 | horizontal system framework |
| 1400 | support tray for refrigeration circuit |

FIGS. 34A and 34B turn concepts introduced in earlier exemplary embodiments as a modular horizontal rack applied with framework and a fixed horizontal chase for a low profile chiller, heater/chiller or pump set that can be ceiling, floor or subfloor mounted. FIGS. 34A and 34B build upon FIGS. 5A and 6A showing more detail for the framework required to mount a horizontal system under an air-cooled condenser or cooler (see FIGS. 5A and 6A). The horizontal rack system can mount indoors in either a ceiling plenum area or a floor plenum area depending upon the airside system design and requirements and use chilled water, hot water, or direct refrigerant based cooling systems.

In view of the wide variety and versatility of the systems and equipment disclosed herein, it is important to recognize and understand the 31 design features, characteristics, capabilities, functions and uses which are set forth above. It is also important to recognize and understand the modifications which are possible for each exemplary embodiment as set forth herein, all within the teachings of the present invention. Additionally, the following further summary of features, characteristics, structures and concepts associated with what is disclosed herein is provided.

A. The exemplary embodiments described herein present a new HVAC and process central plant cooling/heating system design that incorporates all key features of the traditional refrigeration cycle and control components mounting all components in proximity on self-contained trays that are then mounted in a framework that contains multiple trays mounted in a vertical rack configuration. The height of the rack is only limited by the ceiling height of the mechanical equipment space.

B. Each tray in A. above is field removable and mounted vertically or horizontally in structural support framework that accommodates both multiple trays as modular components and includes an integral section that includes fixed piping/valving, electrical wiring/panel/wiring/components, control components, wiring, and operational logic controllers.

C. Each tray employs single or multiple refrigeration circuits including compressor(s), heat exchangers, refrigeration specialties and piping, hydronic piping/valving and electrical/control panel, wiring and components.

D. The fixed vertical piping/electrical chase includes isolation valves to allow single or multiple tray removal while all remaining trays in the rack remain operational.

E. The automated isolation and flow control valves for each tray allow the refrigerant cycle to produce chilled water, or warm water (typically up to 140 degrees F. when using R410A) or simultaneously provide both chilled and warm water depending on heating/cooling load requirements. During intermediate or cold seasons when there is a simultaneous heating and cooling requirement the heater/chiller trays can provide cooling while simultaneously recovering condenser heat for HVAC heating and domestic hot water supply. In mild weather, when there is a greater cooling than heating requirement, the heater/chiller tray(s) operates to satisfy the heating load while simultaneous cooling only modules contribute the additional required cooling capacity. During summer months when there is a requirement for dehumidification, one or more trays can provide cooling while one or more trays can supply heating hot water for reheat simultaneous with chilled water to the cooling load.

F. The design of the componentry in A.-E. above includes all major components for a complete central heating and cooling energy plant: chillers, heater/chillers, DX, VRV/VRF, heat rejection, boilers, pumping system, piping systems, electrical system and control system.

G. Items disclosed in A.-E. above can be installed in a different vertical or horizontal configuration with heat rejection components such as adiabatic or dry heat rejection equipment as a "single package" outdoor chiller or heater/chiller system.

G(1) When required, control valves and logic integrate various types of air or water cooled heat rejection/heat recovery and geothermal can be combined with the disclosed exemplary modules.

G(2) The exemplary embodiments illustrated and described herein include has valves and operational control logic to operate as a geothermal heater/chiller providing compression based cooling only, heating only and simultaneous heating+cooling and a hybrid geothermal mode when installed with a remote air cooled dry or wet cooler. In addition to supplemental heat rejection the cooler can "cool charge" the geothermal loop when low dry bulb (dry cooler) or wet bulb (adiabatic cooler) outside air can provide a source to pre-cool the in-ground loop before the next day's operation. Additional "sensible only cooling may be available from the geothermal (pre-cooled) loop or the wet/dry cooler H. The exemplary embodiments can be supplied as solely a stand alone cooling only, heating/cooling or heating only vertical rack unit with simplified automatic or manual control/isolation valves and without including the following claims.

I. In the heating-only framework piping from/to multiple types of heat sources can be combined in a series arrangement with lower temperature compression cycle heating piped first in-line adding lower temperature heat from heat recovery, geothermal or solar thermal sources and lastly including condensing or non-condensing boilers depending on required discharge hot water temperatures as the final heat source.

J. Larger tonnage systems employ multiple vertical rack arrays for large commercial, institutional HVAC or process heating and cooling projects.

K. Smaller tonnage systems, both for residential and light commercial would have smaller racks with fewer trays.

L. Trays within the vertical or horizontal rack system or separate racks or skids can house the pumping equipment, pump trim and hydronic specialties and accessory heat exchanger. Pumps with digital variable speed electrically commutated motors or VFDs react to open and closed valves and the associated refrigeration equipment to provide proper system pressure/flow.

M. Where floor space or vertical height is not available, the air conditioning modules can be installed in a horizontal rack framework, similar to the horizontal rack configuration in FIG. 6A, with a horizontal piping, valves, electrical and control chase that is either ceiling or floor mounted.

N. A central energy plant master control system, Prime Controller, includes all software or machine language for control of all heating, cooling, pumping and control components with the exception of remotely mounted flow control/monitoring components or the airside equipment handling the occupied space heating/cooling requirements.

O. Typical central plants require multiple types of equipment and componentry normally supplied from many separate sources requiring a custom design for each central plant. The exemplary embodiments combine equipment and componentry using an internet based software selection/configuration program that incorporates design and system layout for building floor space requirements.

P. When a complete system is purchased, the purchase price includes the active participation of a local/regional Systems Integrator to assist in the initial system design, equipment purchase, installation guidance, system start-up and commissioning with further maintenance and system service through the life of the system.

Q. It is contemplated that the exemplary embodiments will use a digital supply chain that allows an architect, engineer, building owner, or design/build team to work directly with the selected system embodiment and the Systems Integrator. The system integrator supplies single source responsibility for all design, purchasing and operational requirements of the system HVAC or process heating/cooling system.

R. While the exemplary embodiments significantly reduce the footprint of the central energy plant system, it is also volumetrically more efficient and significantly reduces the onsite installation labor cost. Future expansion or capacity upgrade is easily built into the initial system design and the disclosed systems are easily configured to N+1 or N+2 requirements.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A racked modular system comprising:

a first plurality of equipment modules;

a second plurality of equipment modules;

a first storage rack constructed and arranged to support said first plurality of equipment modules in a vertical stack;

a second storage rack constructed and arranged to support said second plurality of equipment modules in a vertical stack; and a plurality of water manifolds constructed and arranged for providing a common connection for said first plurality of equipment modules and for said second plurality of equipment modules;

wherein said first storage rack and said second storage rack each have water pipes communicating with manifolds of said plurality of water manifolds;

wherein said first plurality of equipment modules includes a first modular chiller comprising a structural housing supporting a compressor, a condenser, an evaporator, a control panel, a water inlet, and a water outlet and a second modular chiller comprising a structural housing supporting a compressor, a condenser, an evaporator, a control panel, a water inlet, and a water outlet;

wherein said water inlet and said water outlet of said first and second modular chillers are connectable to said water pipes of said first storage rack so as to place said first and second modular chillers in fluid communication with said manifolds of said plurality of water manifolds when said first and second modular chillers are supported by the first storage rack; and wherein the first and second modular chillers are receivable and removable from the first storage rack individually as units.

2. The racked modular system of claim 1 wherein said equipment modules are modular chillers.

3. The racked modular system of claim 1 which further includes a pipe chase.

4. The racked modular system of claim 1 wherein said first storage rack includes a plurality of slide out rails.

5. The racked modular system of claim 1 wherein said second storage rack includes a plurality of slide out rails.

6. The racked modular system of claim 1 wherein said modular chiller includes a closed-refrigerant loop extending from said compressor to said condenser, from said condenser to said evaporator, and from said evaporator to said compressor.

7. The racked modular system of claim 1 wherein said plurality of water manifolds include a chilled water outlet manifold, a condenser water inlet manifold and a condenser water outlet manifold.

8. The racked modular system of claim 7 wherein said plurality of water manifolds further includes a chilled water inlet manifold.

9. The racked modular system of claim 1 which further includes an electrical module.

10. The racked modular system of claim 9 which further includes a sound dampening structure and a ventilation fan.

11. A racked modular system comprising:

a first plurality of equipment modules;

a first storage rack constructed and arranged to support said first plurality of equipment modules in a vertical stack; and a water manifold constructed and arranged for providing a common connection for said first plurality of equipment modules;

wherein said first storage rack has water pipes communicating with said water manifold;

wherein said first plurality of equipment modules includes a first modular chiller comprising a structural housing supporting a compressor, a condenser, an evaporator, a control panel, a water inlet, and a water outlet and a second modular chiller comprising a structural housing supporting a compressor, a condenser, an evaporator, a control panel, a water inlet, and a water outlet;

wherein said water inlet and said water outlet of said first and second modular chillers are connectable to said water pipes of said first storage rack so as to place said first and second modular chillers in fluid communication with said water manifold when said first and second modular chillers are supported by the first storage rack; and wherein the first and second modular chillers are receivable and removable from the first storage rack individually as units.

12. The combination of claim 11 wherein said equipment module is a refrigeration module including a heat exchanger.

13. The combination of claim 11 wherein said storage rack includes fixed hydronic piping.

14. The combination of claim 11 wherein said water inlet and said water outlet of said first and second modular chillers are connected to said water pipes of said first storage rack with a flex connector.

15. The combination of claim 11 wherein said equipment module includes a plurality of isolation valves and said storage rack includes a plurality of isolation valves.

16. The racked modular system of claim 11 wherein said modular chiller includes a closed-refrigerant loop extending from said compressor to said condenser, from said condenser to said evaporator, and from said evaporator to said compressor.

17. The combination of claim 11 wherein the storage rack is constructed and arranged to provide water to said plurality of equipment modules in parallel.

18. An outdoor cooler or condensing system comprises in combination with the claim 11 racked modular system an air cooled condenser or fluid cooler.

19. The system of claim 18 wherein said air cooled condenser or fluid cooler is positioned above said plurality of equipment modules.

20. The system of claim 18 wherein said air cooled condenser or fluid cooler is positioned to the side of said plurality of equipment modules.

* * * * *